US009951572B2

(12) United States Patent
Magnuson

(10) Patent No.: US 9,951,572 B2
(45) Date of Patent: Apr. 24, 2018

(54) X-Y-Z PIPE RACKER FOR A DRILLING RIG

(71) Applicant: Nabors Industries, Inc., Houston, TX (US)

(72) Inventor: Christopher Magnuson, Houston, TX (US)

(73) Assignee: Nabors Industries, Inc., Houston, TX (US)

( * ) Notice: Subject to any disclaimer, the term of this patent is extended or adjusted under 35 U.S.C. 154(b) by 0 days.

(21) Appl. No.: 15/354,686

(22) Filed: Nov. 17, 2016

(65) Prior Publication Data

US 2017/0096866 A1 Apr. 6, 2017

Related U.S. Application Data

(63) Continuation of application No. 14/159,722, filed on Jan. 21, 2014, now Pat. No. 9,562,407.

(60) Provisional application No. 61/755,727, filed on Jan. 23, 2013.

(51) Int. Cl.
*E21B 19/14* (2006.01)

(52) U.S. Cl.
CPC ..... *E21B 19/14* (2013.01)

(58) Field of Classification Search
CPC ..... E21B 15/00; E21B 19/14; E21B 19/20; B25J 5/04; B25J 9/0084
USPC ..... 211/70.4; 376/269, 271; 414/154, 414/22.51–22.59, 22.61–22.69, 22.71, 23, 414/24, 271, 561, 267, 279, 284, 342, 414/633; 212/312, 315, 319
See application file for complete search history.

(56) References Cited

U.S. PATENT DOCUMENTS

| | | | | |
|---|---|---|---|---|
| 758,399 | A | 4/1904 | Wilke | |
| 3,583,583 | A | 6/1971 | Martin | |
| 3,672,305 | A * | 6/1972 | Richins | B60V 3/025 104/130.01 |
| 3,978,993 | A | 9/1976 | Howard | |

(Continued)

FOREIGN PATENT DOCUMENTS

| | | |
|---|---|---|
| GB | 2150962 | 7/1985 |
| GB | 2160564 | 12/1985 |
| GB | 2322395 | 8/1998 |

OTHER PUBLICATIONS

International Application Serial No. PCT/US2014/012540, Search Report and Written Opinion dated May 7, 2014, 13 pgs.

*Primary Examiner* — Gregory W Adams
(74) *Attorney, Agent, or Firm* — Haynes and Boone, LLP

(57) ABSTRACT

Apparatus and methods include an x-direction support structure extending in the same direction as a line extending between a well center and a V-door on a drilling rig and include a y-direction support structure moveable along the x-direction support structure. The y-direction support structure extends on a drilling rig in a direction transverse to the line extending between the well center and the V-door on the drilling rig. A racker device is carried by the y-direction support structure and is configured to connect to and carry a tubular stand used in a well drilling process, the racker device being moveable along the y-direction support structure from a position inline with the line extending between the well center and the V-door on the drilling rig to a position offline from the line to provide space for additional drilling processes along the line extending between the well center and the V-door on the drilling rig.

20 Claims, 16 Drawing Sheets

(56) References Cited

U.S. PATENT DOCUMENTS

| | | | |
|---|---|---|---|
| 4,109,800 | A | 8/1978 | Howard et al. |
| 4,252,217 | A | 2/1981 | Benjamin |
| 4,462,733 | A | 7/1984 | Langowski et al. |
| 4,505,630 | A | 3/1985 | Kaschner et al. |
| 4,538,954 | A | 9/1985 | Luebke |
| 4,610,315 | A | 9/1986 | Koga et al. |
| 4,664,873 | A | 5/1987 | Hendrich et al. |
| 4,696,207 | A | 9/1987 | Boyadjieff |
| 4,750,429 | A | 6/1988 | Mordaunt et al. |
| 4,765,401 | A | 8/1988 | Boyadjieff |
| 5,238,348 | A | 8/1993 | Reimer |
| 5,244,329 | A | 9/1993 | McGill et al. |
| 5,423,390 | A | 6/1995 | Donnally et al. |
| 5,437,527 | A | 8/1995 | McGill et al. |
| 5,445,282 | A | 8/1995 | Erikkila |
| 6,068,066 | A | 5/2000 | Byrt et al. |
| 6,343,662 | B2 | 2/2002 | Byrt et al. |
| 6,926,488 | B1 | 8/2005 | Bolding et al. |
| 6,976,540 | B2 | 12/2005 | Berry |
| 7,073,634 | B2 | 7/2006 | Mitchell et al. |
| 7,214,022 | B2 | 5/2007 | Melching |
| 7,246,983 | B2 | 7/2007 | Zahn et al. |
| 7,281,608 | B2 | 10/2007 | Hansl et al. |
| 7,699,122 | B2 | 4/2010 | Eriksen |
| 7,802,636 | B2 | 9/2010 | Childers et al. |
| 7,967,541 | B2 | 6/2011 | Stroshein et al. |
| 2008/0164064 | A1 | 7/2008 | Belik et al. |
| 2010/0303586 | A1 | 12/2010 | Hankins et al. |
| 2012/0217024 | A1 | 8/2012 | Childers et al. |
| 2012/0305261 | A1 | 12/2012 | Roodenburg et al. |

* cited by examiner

X-Y-Z PIPE RACKER FOR A DRILLING RIG

PRIORITY

This application is a continuation of U.S. patent application Ser. No. 14/159,722, filed Jan. 21, 2014, titled, "X-Y-Z Pipe Racker for a Drilling Rig" which claims priority to and the benefit of the filing date of U.S. Provisional Patent Application No. 61/755,727, filed Jan. 23, 2013, titled, "X-Y-Z Pipe Racker for a Drilling Rig," the entire contents of both applications which are incorporated herein by reference thereto.

TECHNICAL FIELD

The present disclosure is directed to systems, devices, and methods for the manipulation, assembly and moving of tubulars within a derrick or mast in oil and gas drilling systems. More specifically, the present disclosure is directed systems, devices, and methods including a modular rig-up pipe racking system that can manipulate tubulars for assembly, racking, or other tasks useful in the drilling industries.

BACKGROUND OF THE DISCLOSURE

The exploration and production of Hydrocarbons require the use of numerous types of tubulars also referred to as pipe. Tubulars include but are not limited to drill pipes, casings, and other threadably connectable elements used in well structures. Strings of joined tubulars, or drill strings, are often used to drill a wellbore and, with regards to casing, prevent collapse of the wellbore after drilling. These tubulars are normally assembled in groups of two or more commonly known as "stands" to be vertically stored in the derrick or mast. The derrick or mast may include a storing structure commonly referred to as a fingerboard. Fingerboards typically include a plurality of vertically elongated support structures or "fingers" each capable of receiving a plurality of "stands."

Rotary Drilling and Top Drive drilling systems often use these stands, instead of single tubulars, to increase efficiency of drilling operations by reducing the amount of connections required to build the drill string in or directly over the wellbore. However the manipulation of tubulars from a horizontal to a vertical position, assembly of stands and presentation of stands between the fingerboard and wellcenter are dangerous and can be rather inefficient operations.

The ability to build stands while simultaneously drilling allows numerous activities to be conducted simultaneously, thus gaining efficiency. However, due to the small rig floors and mobile nature of land rigs, both automated rackers and offline standbuilding systems have not been possible in the land rigs. In addition, safety of the rig crew is a critical aspect of drilling operations and specifically the removal of rig personnel from the rig floor has been a goal in the industry. One known system described in patent application publication 2010/0303586 allows for the manipulation of tubulars. The system however, still requires rig personnel to tail the tubulars on the rig floor to ensure proper positions of stands in the setback. Another known system described in U.S. Pat. No. 7,967,541, while an improvement to the system of 2010/0303586 by eliminating rig personnel from the rig floor during racking operations, still requires rig personnel to build stands. Neither of the systems in the references identified above assists in the make-up of stands. Both systems do not assist in the manipulations of tubulars from the catwalk to well center or an offline mousehole thus requiring rig personnel to utilize wenches for the manipulation of tubulars from the horizontal to vertical position. Furthermore, both of these systems transfer the weight of the stand through the fingerboards and into the mast/derrick.

The present disclosure is directed to systems and methods that overcome one or more of the shortcomings of the prior art.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIG. 5-1 is a schematic of an exemplary apparatus according to one or more aspects of the present disclosure showing a floor track.

FIG. 5-2 is a schematic of an exemplary apparatus according to one or more aspects of the present disclosure showing a floor track.

FIG. 5-3 is a schematic of an exemplary apparatus according to one or more aspects of the present disclosure showing a floor track.

FIG. 8-1 is a schematic showing movement capability of an exemplary apparatus according to one or more aspects of the present disclosure.

FIG. 8-2 is a schematic showing movement capability of an exemplary apparatus according to one or more aspects of the present disclosure.

FIG. 8-3 is a schematic showing movement capability of an exemplary apparatus according to one or more aspects of the present disclosure.

FIG. 8-4 is a schematic showing movement capability of an exemplary apparatus according to one or more aspects of the present disclosure.

FIG. 8-5 is a schematic showing movement capability of an exemplary apparatus according to one or more aspects of the present disclosure.

FIG. 8-6 is a schematic showing movement capability of an exemplary apparatus according to one or more aspects of the present disclosure.

DETAILED DESCRIPTION

Figure 1:
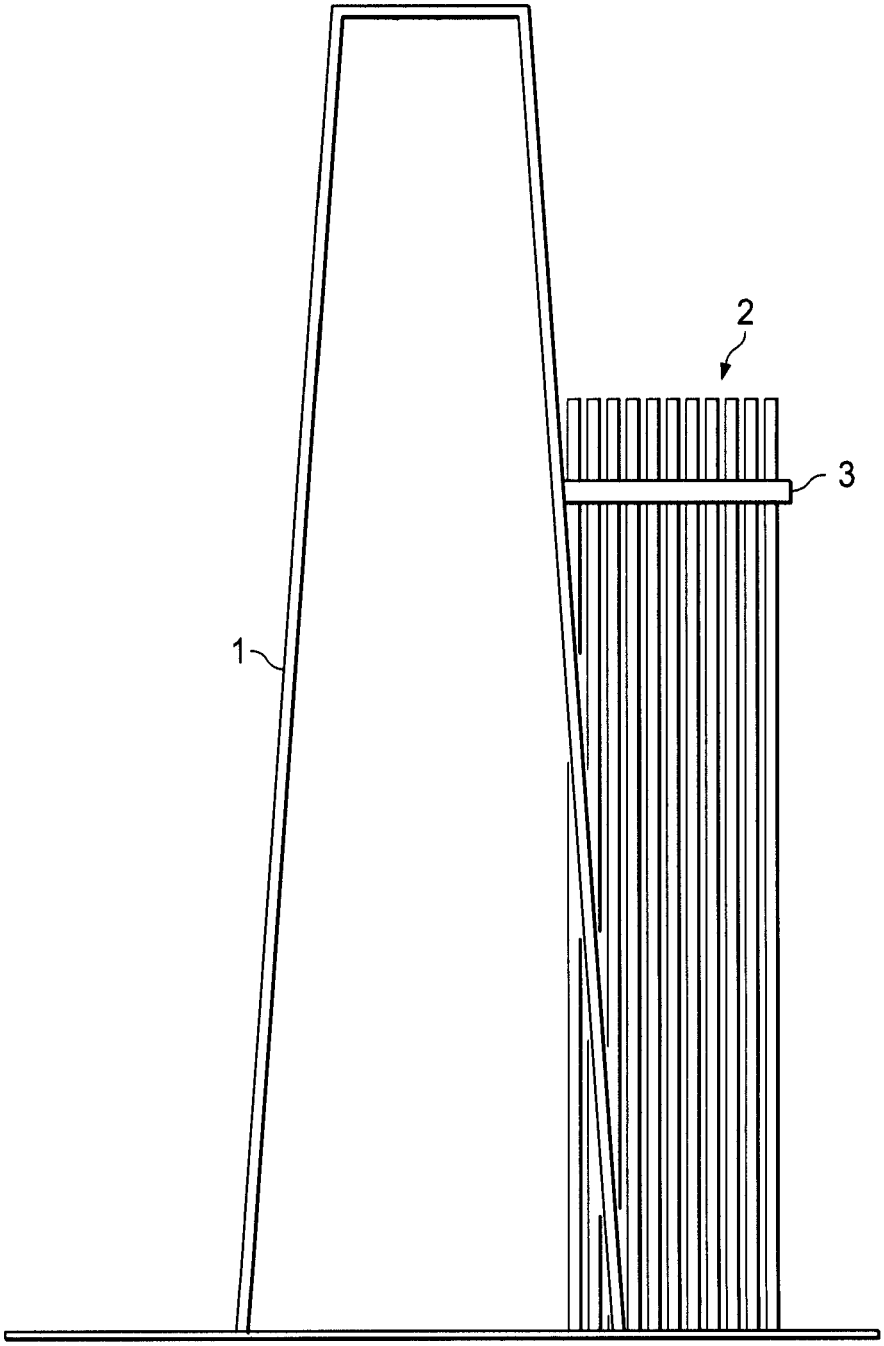
FIG. 1 is a schematic of an exemplary conventional apparatus.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The systems, devices, and methods described herein may be used to manipulate pipe around a mobile drilling rig. For example, the systems, devices, and methods may be used to transfer pipe including tubulars such as drilling pipe, tubing, and casing from a horizontal position presented by a catwalk or other conveyance to a vertical position and to manipulate the transferred pipe into a mousehole for the building of stands. In some embodiments, through the use of a powered mousehole and an iron roughneck for the make-up of threaded tubulars, a complete stand may be built without rig personnel being required on the drill floor. That is, the pipe manipulation may be completely automated and may be performed under the control of a controller that sends signals or monitors each aspect of the systems, devices, and methods disclosed herein.

Furthermore, the systems, devices, and methods in this disclosure may be used to hoist a built stand out of the mousehole and clear of a drill floor through the use of an integrated upper and lower manipulator arms and gripper heads. Thus, the systems, devices, and methods in this disclosure may allow a built stand to be hoisted from the mousehole and racked in a fingerboard of a mast/derrick without the need for rig personnel to be on the rig floor. This may also allow for stand building and racking operations to occur simultaneous to drilling operations at well center.

The systems, devices, and methods disclosed herein, unlike other stand racking systems, include a column racking device that moves in both x and y-directions, expand its upper and lower manipulator arms, and rotate about an axis in an angular manner. This type of movement may permit offline stand building in a manner not previously obtainable. Movement in the x and y-directions is possible due to the arrangement of support structures that carry a racker device. In some embodiments, this support structure is located at an elevation above the fingerboard allowing clearance between the upper support structures and stands as they may already exist. Unlike the systems disclosed herein, traditional column rackers are positioned at the fingerboard level and are limited to movement in only one direction.

The systems, devices, and methods described herein allow a racker device, with drive carriages, to move in the x and y-directions. This allows the racker device to perform its pipe manipulation functions while online, but also allows the racker device to be stowed in an offline position and allow direct access to the well center from a V-door for casing or other operational requirements. If the racker device is found to have mechanical issues, it can be returned to its stowed position allowing a conventional diving board to be rotated into the horizontal position from its stowed vertical position and manual operations to commence.

The modular design of this racker device allows for its easy transportation and rigup. In some aspects, the racker device includes guide cables for the stands that may be assembled in the mousehole and attached to one or more drive carriages. For example, the guide cables may be used to hoist an upper drive carriage that grips the stands to manipulate the stands as desired.

This systems, devices, and methods possess numerous other advantages, and have other purposes which may be made more clearly apparent from the consideration of the attached embodiments. These embodiments are shown in the drawings accompanying this description. The embodiments will now be described in detail, for the purpose of illustrating the general principals of the systems, devices, and methods, but it is to be understood that one skilled in the art is not to be taken in a limiting sense, since the scope of the invention is best defined by the appended claims.

Figure 2:
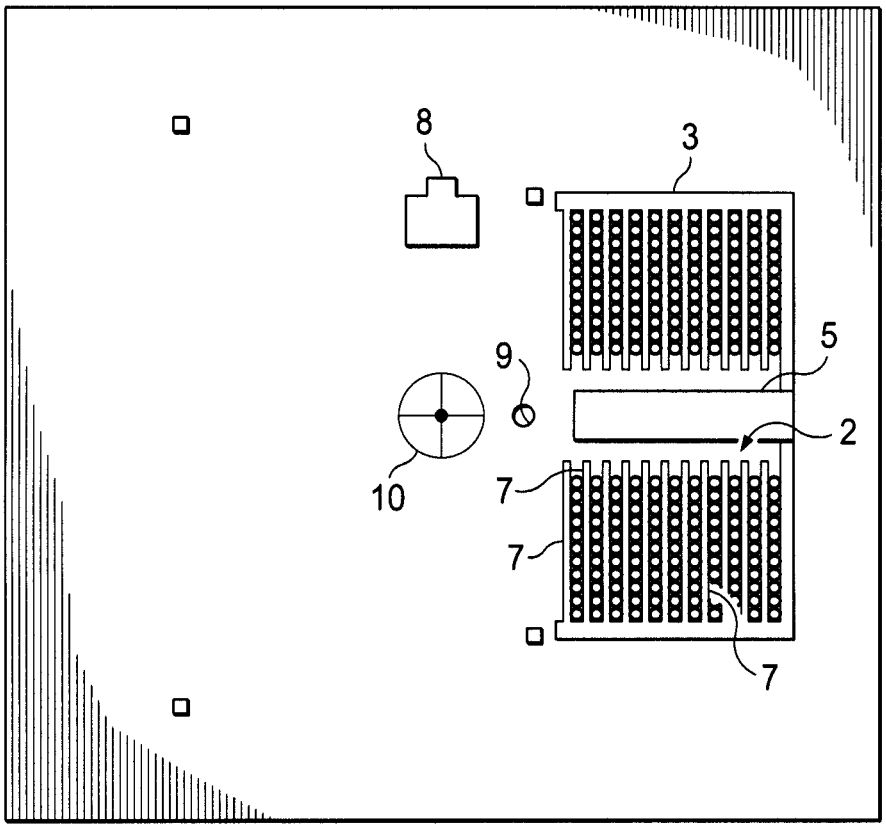
FIG. 2 is a schematic of a top view of the conventional apparatus of FIG. 1.

FIG. 1 and FIG. 2 show a conventional system from a side view and a top view respectively in order to compare some of the unique features of the systems, devices, and methods disclosed herein. The conventional system shown may form a part of a mobile drilling rig. Because of their mobile natures, mobile drilling rigs typically have small drill floors of about 35×35 ft. Because of their compact size, mobile drilling rigs are conventionally configured to build stands on-line, or inline with well center. Referring first to the side profile shown in FIG. 1, the conventional system includes a traditional mast 1, traditional drillpipe (in stands) 2, and a traditional fingerboard 3.

FIG. 2 shows a vertical profile of the conventional drilling rig. It includes the fingerboard 3, a diving board 5 (here shown in a horizontal position), stands 2, fingers 7, an iron roughneck 8, a mousehole 9, and a well center 10. In the conventional rig shown in FIG. 2, the diving board 5 extends between opposing fingers of the fingerboard 4 and is aligned with both the mousehole 9 and the well center 10. In addition, the diving board 5 is disposed at an elevation lower than the upper ends of the stands 2.

Figure 3:
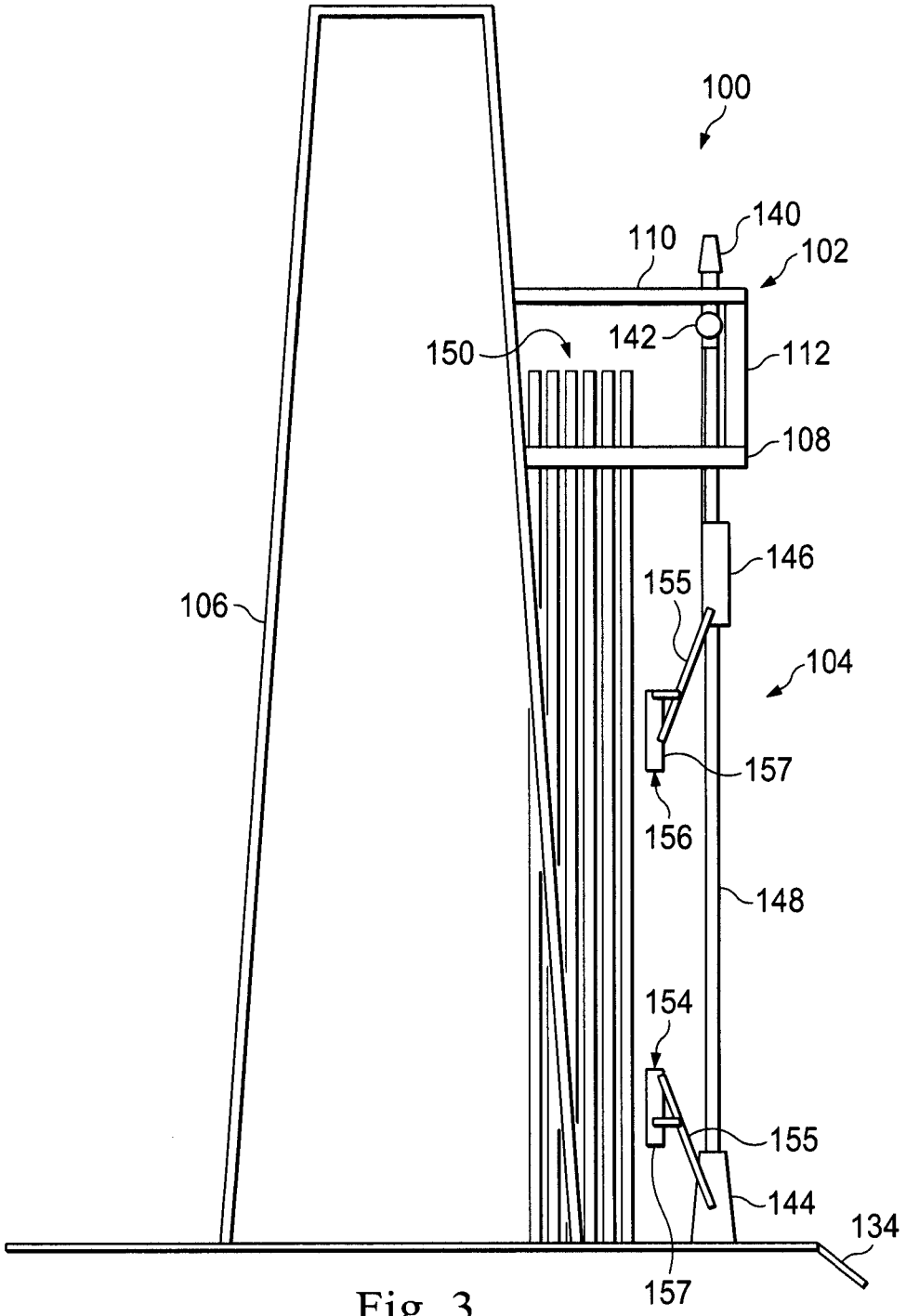
FIG. 3 is a schematic of an exemplary apparatus according to one or more aspects of the present disclosure.
Figure 4:
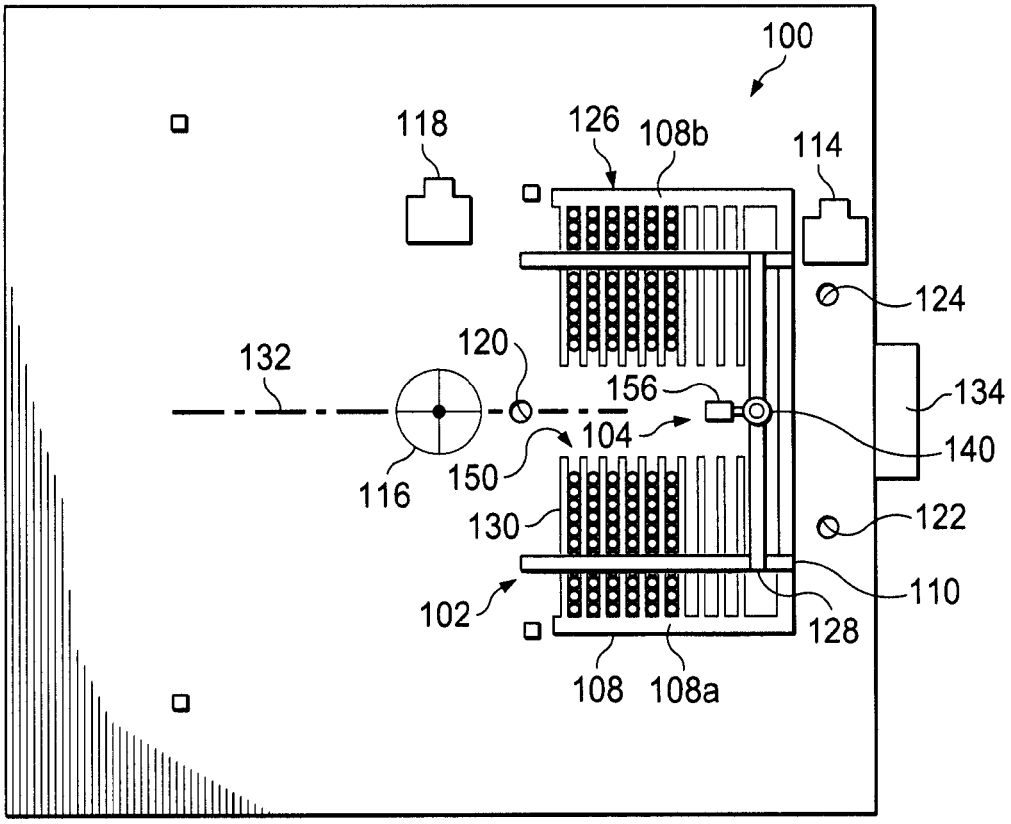
FIG. 4 is a schematic of a top view of the apparatus of FIG. 3 according to one or more aspects of the present disclosure.

FIGS. 3 and 4 show the improved system 100 of the present disclosure, with FIG. 3 showing a side profile and FIG. 4 showing a vertical profile of the system. The system 100 may form a part of a mobile drilling rig having a drillfloor size of about 35×35 ft, although larger and smaller rigs are contemplated. In some embodiments, the rig is smaller than about 1600 square feet. In other embodiments, the rig is smaller than about 1200 square feet. The system 100 disclosed herein is particularly useful because it permits a racker device to be used on rigs that are limited in size. As will be explained below, the system 100 is arranged to build stands off-set from wellcenter, or offset from a travel path between well center and a v-door, while being maintained on a standard sized mobile drilling rig. In some embodiments, the system 100 may build stands using an off-set mousehole in the drill floor. Therefore, the system 100 may operate more efficiently by permitting the well center operations, such as drilling, to be performed while building stands in a mousehole simultaneously. It may do this because the mousehole to build stands is offset and does not interfere with drilling operations. As such, the process of stand-building does not impact the rigs ability to perform drilling operations at well center.

The system 100 shown in FIGS. 3 and 4 includes a rig 101 with rig based structures and support 102 and a racker device 104 that operates on the rig based structures and support 102. The rig based structures and support 102 include, for example, a mast 106, a fingerboard 108, an x-direction drive support structure 110, a diving board 112 stowed in a vertical position to allow system operation, an offline iron roughneck 114, well center 116, a well center roughneck 118, a drill-floor mousehole 120, a left side offline mousehole 122, an right side offline mousehole 124, fingerboard support structure 126, a y-direction drive support structure 128, and fingers 130 of the fingerboard 108. As used herein, the left side is the portion of the system on the left side of a center line 132 when looking from a v-door 134 on the rig 101 toward the well center 116 and the right side is the portion of the system 100 on the right side of the center line 132 when looking from the v-door 134 toward the well center 116.

The racker device 104 includes a modular racker upper column drive 140, a modular racker hoist 142, a lower drive carriage 144, an upper drive carriage 146, and a racker support column 148. Drill pipe stands 150 are shown in FIGS. 3 and 4 and may be transferred by the racker device 104 on the rig based structures and supports 102 to positions in a mousehole for assembly or disassembly, transferred into and out of the fingerboard 108, and transferred into or out of the well center 116.

The racker support column 148 may be formed of a single beam or multiple beams and may be formed in a single or multiple lengths joined together. In some embodiments, the racker support column 148 is a structural support along which the upper drive carriage 146 may move upward or downward on wheels.

In some exemplary embodiments, the upper column drive 140 is configured to move the upper portion of the racker support column 148 along the y-direction support structure and along the x-direction support structure. Accordingly, it may have a portion disposed at the interface between the y-direction support structure 128 and the racker support column 148, and it may have a portion disposed at the interface between the y-direction support structure and the x-direction support structure 110. In addition, it may operate the racker hoist 142 and may be configured to raise and lower the upper drive carriage 146 along the racker support column 148. The racker hoist 142 may be in operable engagement with the upper column drive 140 and may be driven by the upper column drive 140. It moves the upper drive carriage 146 up or down in the vertical direction along the racker support column 148.

The lower drive carriage 144 and the upper drive carriage 146 cooperate to manipulate tubulars and/or stands. The lower drive carriage 144 also includes a drive system that allows the lower drive carriage 144 to displace along the rig floor. In some embodiments, this occurs along rails or tracks as discussed below. The lower and upper drive carriages 144, 146 may respectively include a lower manipulator arm and gripper head 154 and an upper manipulator arm and gripper head 156. Each includes manipulator arm 155 and a gripper head 157. The gripper heads 157 may be sized and shaped to open and close to grasp or retain tubing, such as tubulars or stands. The manipulator arms 155 may move the gripper heads 157 toward and away from the racker support column 148. These upper and lower manipulator arm and gripper heads 156, 154 are configured to reach out to insert a drill pipe stand into or remove a drill pipe stand from fingerboard 108. That is, the upper and lower manipulator arm and gripper heads 156, 154 extend outwardly in the y-direction from the racker support column 148 to clamp onto or otherwise secure a drill pipe stand that is in the fingerboard 108 or to place a drill pipe stand in the fingerboard. As indicated above, the upper drive carriage 146 may operate in a z-direction along the racker support column 148. In some aspects, it is operated by the hoist 142.

Figure 6:
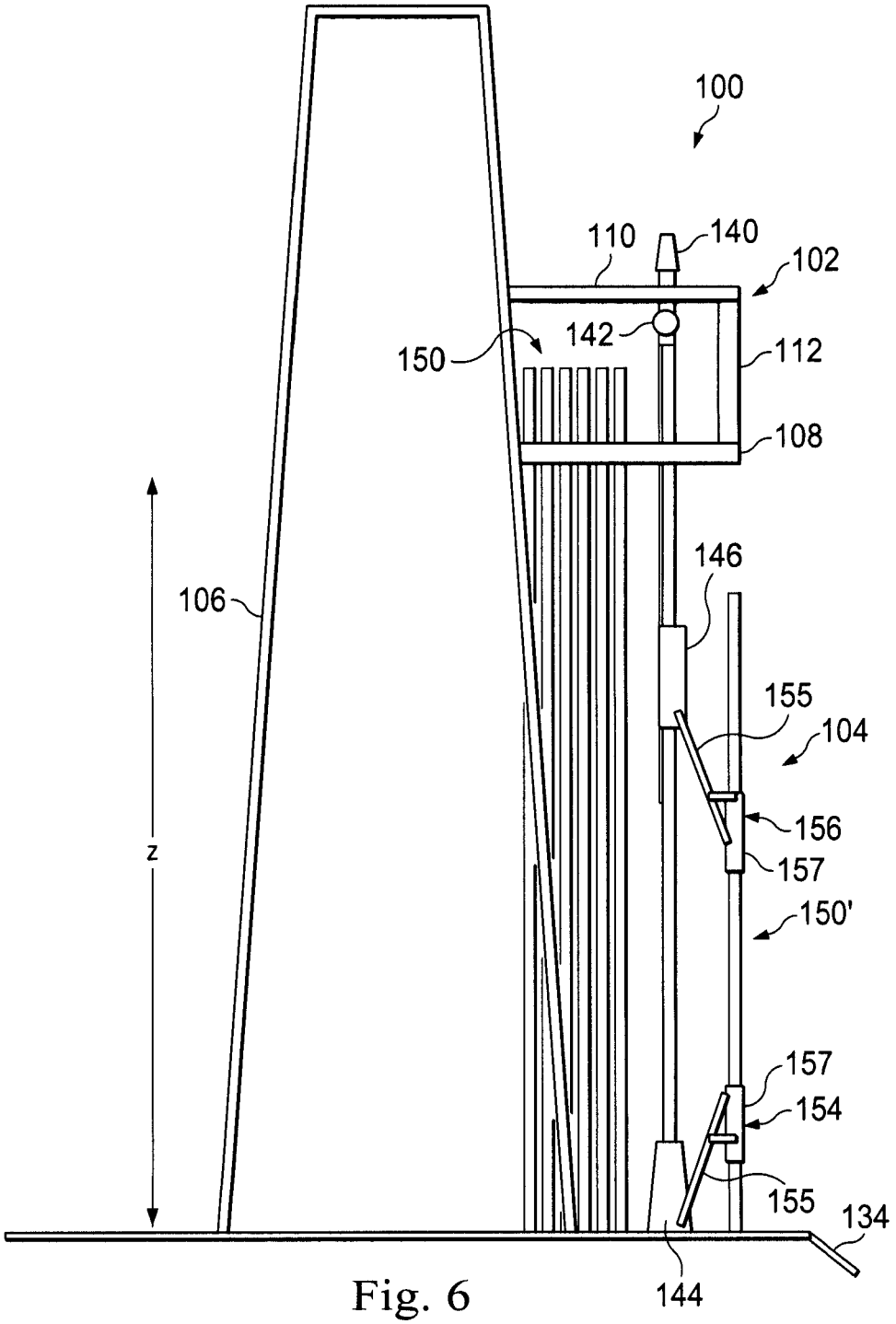
FIG. 6 is a schematic of an exemplary apparatus according to one or more aspects of the present disclosure.

The fingerboard 108 is a rack formed of a plurality of fingers 130 spaced to receive pipe stands and maintain the pipe stands in a substantially vertical orientation. The fingers extend in parallel, and in the embodiment shown, form a left side fingerboard portion 108*a* and a right side fingerboard portion 108*b* These portions 108*a*, 108*b* in FIG. 6 are aligned so that the fingers 130 all extend in parallel lines in a direction substantially perpendicular to a line extending between well center 116 and a v-door 134. In other embodiments, the fingers 130 of each portion are parallel to each other and oblique to a line extending between well center 116 and a v-door 134. The spacing between the two portions 108*a*, 108*b* of the fingerboard 108 forms a gap 113 that provides a travel path for racker device 104, as will be explained further below. The fingerboard support structure 126 is a frame support structure that supports the fingers and provides rigidity to the fingerboard 108.

In the embodiment shown, the x-direction drive support structure 110 and the y-direction drive support structure 128 are structural beams disposed at a higher elevation than the fingerboard 108. In some embodiments, the x-direction drive support structure 110 and the y-direction drive support structure 128 are disposed at a higher elevation than stands within the fingerboard 108. For example, they may be disposed to be higher than a triple stand. In the exemplary embodiment shown, the x-direction drive support structure 110 includes two parallel support structures extending in an x-direction parallel to the gap 113 between the portions 108*a*, 108*b* of the fingerboard 108. In some embodiments, the x-direction drive support structure 110 may be fixed in place relative to the mast 106 and other supporting structure. The y-direction drive support structure 128 may be carried by the x-direction drive support structure 110 and may move in the x-direction along the x-direction drive support structure 110. In this embodiment, the y-direction drive support structure 128 is a beam disposed perpendicular to the x-direction drive support structure 110. The y-direction drive support structure 128 may extend in any transverse direction. As will be explained below, the racker device 104 may move along the y-direction drive support structure 128, thereby providing mobility to the racker device 104 in the y-direction. In addition, the y-direction drive support structure 128 may move along the x-direction drive support structure 110, thereby providing mobility to the racker device 104 (carried by the y-direction support structure 128) in the x-direction. It is worth noting that during standard operation of manipulating stands, the racker column support 148 of the racker device 104 may move in the x-direction in the gap 113 between the portions of the fingerboard 108, while the upper and lower manipulator arm and gripper heads 156, 154 are configured to extend outwardly in the y-direction from the racker support column 148 when placing a stand in or removing a stand from the fingerboard 108.

As can be seen in FIG. 4, the x-direction drive support structure 110 is offset from a line 132 in the x-direction extending between well center 116 and the v-door 134. Because of this, the racker support column 148 may be moved in the x-direction, but also may be stowed or moved offline in the y-direction. As used herein, the term "offline" is meant to include a position that is offset from a line extending in the x-direction through the well center 116 and the v-door 134 of the drilling rig. In FIG. 4, this line is represented by the dashed center line 132, extending between well center 116 and the v-door 134 providing access to the rig floor.

Figures 1, 5:
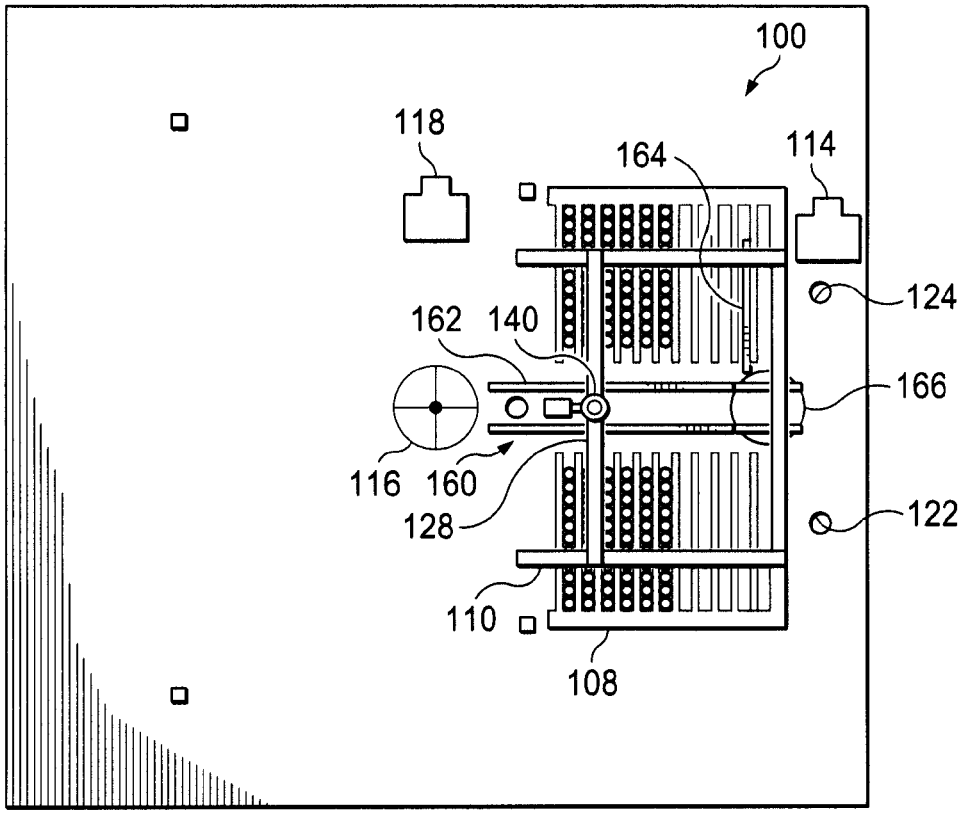
Figures 2, 5:
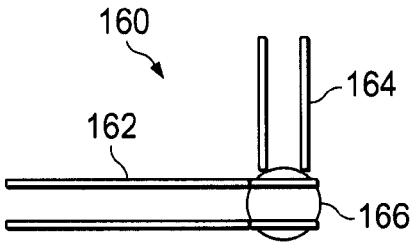
Figures 3, 5:
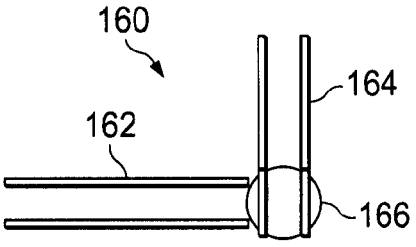

Although not shown in FIG. 4 for clarity, FIG. 5 shows additional supporting structure on the rig floor that may be used to convey the lower end of the racker device 104 in the x and y-directions.

FIGS. 5-1 to 5-3 show a view including bottom tracks 160 which may be used to guide the lower drive carriage 144. In some embodiments, the lower drive carriage include a driver that moves it along the bottom tracks. In this embodiment, the bottom tracks 160 are rails and the lower drive carriage 144 includes wheels or rollers that roll along the rails. The bottom tracks 160 are shown in FIG. 5-1, but have been left off FIG. 4 for clarity with respect to other features. FIGS. 5-1, 5-2, and 5-3 show different orientations of the bottom tracks. FIG. 5-1 shows the bottom tracks 160 relative to the remainder of the system 100 on a mobile drilling rig. FIG. 5-2 shows the bottom tracks 160 independent of the remainder of the system 100 oriented in a first orientation and FIG. 5-3 shows the bottom tracks independent of the remainder of the system 100 oriented in a second orientation. Referring to these Figures, the bottom tracks 160 include, in the embodiment shown, an x-direction portion 162, a y-direction portion 164, and a pivot portion 166, which in the embodiment shown is a turntable. As can be seen, the x-direction portion 162 of the bottom tracks 160 is disposed to extend substantially in the direction of well center 116, while the y-direction portion 164 is arranged to extend in a direction transverse to the x-direction and may be used when the racker support column 148 is moved to an offline position in order to provide additional access to the well center for casing or other operational requirements. The lower drive carriage 144 is configured to travel along the bottom tracks 160 as the racker support column 148 is carried along the x-axis portion 162 toward and away from the well center 116. When the support column 148 is to be moved out of the way so that other functionality can be performed on the rig floor, the support column 148 may be moved to the pivot portion 166 when the pivot portion is oriented as shown in FIG. 5-2. With the lower drive carriage 144 on the pivot portion, the pivot portion may be rotated 90° to the position shown in FIG. 5-3. In this position, the lower drive carriage 144 may be driven or advanced along the y-direction portion 164 to an offline position that is not in-line along the line 132 through the well center 116 and the v-door 134. Thus, the upper column drive 140, with the lower drive carriage 146, the lower drive carriage 144, and the racker support column 148 can be moved offline, providing clearance for the operation of other processes or procedures on the rig floor. It should be noted that, as described below, the stowed position or the offline position may correspond to an offline drill pipe stand building position. In some embodiments, the offline position is a stowed position where the system may reside while additional drilling processes are being carried out on the drilling rig. Accordingly, multiple processes may be carried out at a single time to increase the efficiency of operation of the drilling rig.

In one embodiment, the bottom tracks 160 are formed of rails along which the lower drive carriage 144 may roll. For example, the lower drive carriage 144 may include a wheel configured to interface with the rails. In another example, the bottom tracks 160 are indentations in the floor that provide guidance as the lower drive carriage moves. In yet other embodiments, the bottom tracks are formed of slots. Other embodiments are contemplated.

Figure 7:
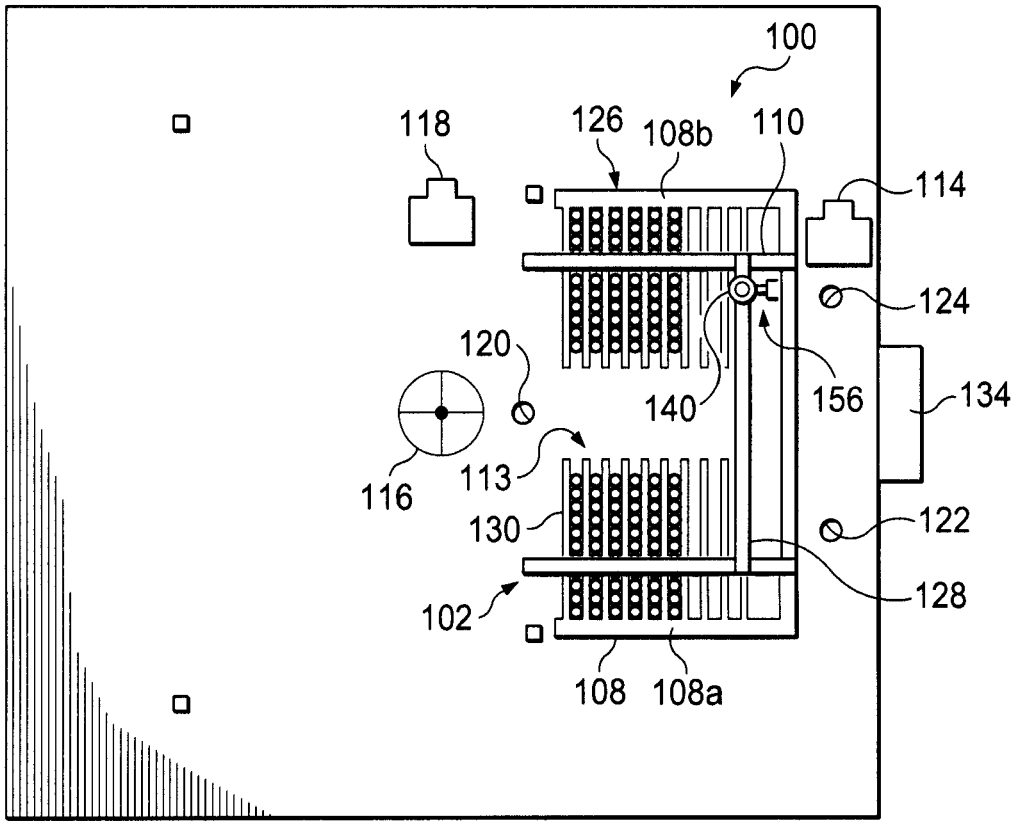
FIG. 7 is a schematic of a top view of the apparatus of FIG. 6 according to one or more aspects of the present disclosure.

FIG. 6 shows a side profile when the racker device 104 is offline and is in the process of building a drill pipe stand 150'. It may do this using the offline mousehole 124. FIG. 7 shows a corresponding top view with the racker device 104 offline in a position to access to the offline mousehole 124. Furthermore, since the height of the x-direction support structure 110 and the y-direction support structure 128 is greater than the stands, when the racker device 104 is offline, the support structures 110, 128 do not interfere with the v-door 134 or other features on the drilling rig. In addition to being offline, the mousehole 124 is also positioned off-well center. Because of this, stand building may occur off-well center utilizing a mousehole, such as the mousehole 124 that is disposed in a position that allows standbuilding free from interference with the drilling equipment at well center, such as a top drive for example. As used herein, the term "off-well center" is meant to include a position that does not interfere with drilling equipment at well center. This may encompass at least a portion of the offline position and at least a portion of the online position.

Referring to FIGS. 6 and 7, the upper column drive 140 is in an offline position by having been moved in the x-direction along the x-direction drive support structure 110 and advanced along the y-direction drive support structure 128 to the position shown in FIG. 7, adjacent the right side mousehole 124. In this position, the racker device 104 may be used to assemble pipe stands using the mousehole 124 and the offline iron roughneck 114. Since the procedure is being performed offline, other processes may be performed at the well center 116, and may include advancing equipment through the v-door and in the area occupied by racker device 104 when the racker device 104 is online. In addition, the upper column drive 140 allows standbuilding to occur off-well center, thereby permitting the well center equipment to operate without interference during standbuilding at well center.

Figures 1, 8:
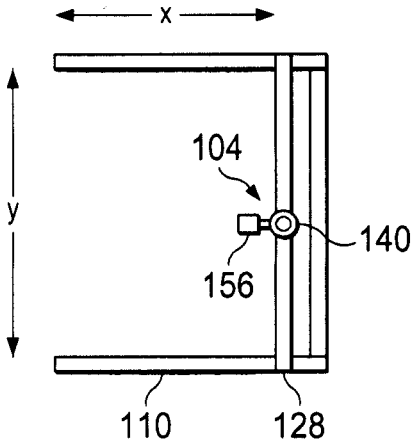
Figures 2, 8:
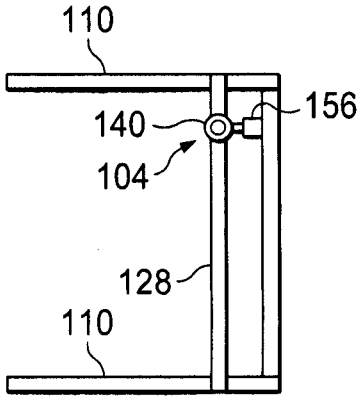
Figures 3, 8:
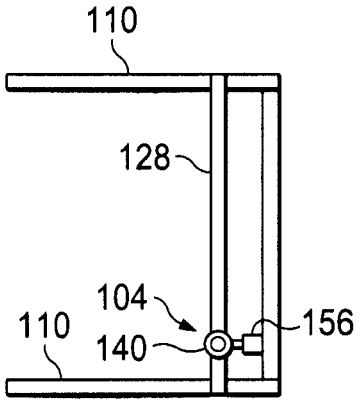
Figures 4, 8:
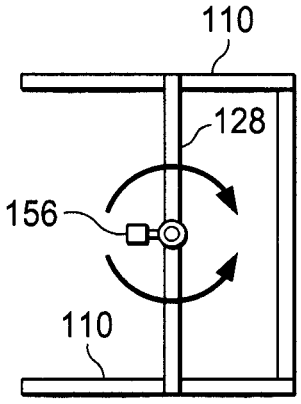
Figures 5, 8:
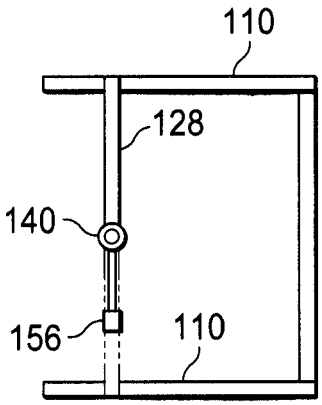
Figures 6, 8:
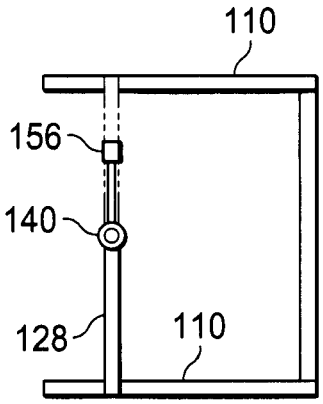

FIGS. 8-1 to 8-6 show some of the movement obtained by the system of the present disclosure to perform pipe stand building, racking, and moving pipe stands to any of the mouseholes 120, 122, 124 or the well center 116.

FIG. 8-1 is a top profile of the upper drive structure of the system 100 with the racker device 104 in a V-door position. FIG. 8-1 shows the racker upper column drive 140, y-direction drive support structure 128, x-direction drive support structure 110, and the upper manipulator arm and gripper head 156. FIG. 8-2 shows the upper drive structure with racker device 104 in right side stowed position. In this stowed position the racker device 104 has been moved in the y-direction along the y-direction drive support structure 128 and is offline, as it is no longer inline with the well center 116 (not shown in FIG. 8-2). It may align with the offline mousehole 124 in FIG. 7, and may be used to build drill pipe stands offline. FIG. 8-3 shows a top profile of an upper drive structure with the racker device 104 in left side stowed position. As discussed with reference to the stowed position shown in FIG. 8-2, the stowed position in FIG. 8-3 is an offline position. It may align with the offline mousehole 122 in FIG. 7, and may be used to build drill pipe stands offline. FIG. 8-4 represents the rotational movement that the racker device 104 may travel. The racker device 104 has angular rotation capability that may be accomplished by rotating the support column 148 or by rotating the lower and upper drive carriages 144, 146 independent of the support column 148. In a preferred embodiment, the lower and upper drive carriages 144, 146 remain aligned as they rotate so that any pipe segment carried by the lower and upper drive carriages 144, 146 may be maintained in a substantially top position. Rotation may be achieved via a rotation driver forming a part of the lower drive carriage 144, the upper column drive 140, or other driver. FIG. 8-5 represents the racker device 104 in a first position, where the upper and lower manipulator arms and gripper heads 156, 154 are extended in the y-direction to access drill pipe stands held between extending fingers 130 of the fingerboard 108 (FIG. 6) on the left side. Accordingly, in some embodiments, the racker support column 148 is maintained online, along with at least portions of the lower and upper drive carriages 144, 146, while at least the upper and lower manipulator arms and gripper heads 156, 154 extend outwardly to place drill pipe stands in the fingerboard 108 or remove them from the fingerboard 108. FIG. 8-6 represents the racker device 104 in a second position, in the right side rotated 180° from the position shown in FIG. 8-5. Accordingly, the upper and lower manipulator arms and gripper heads 156, 154 may extend into either side of the fingerboard 108 to either insert or remove drill pipe stands 150 from the fingerboard 108.

Figure 9:
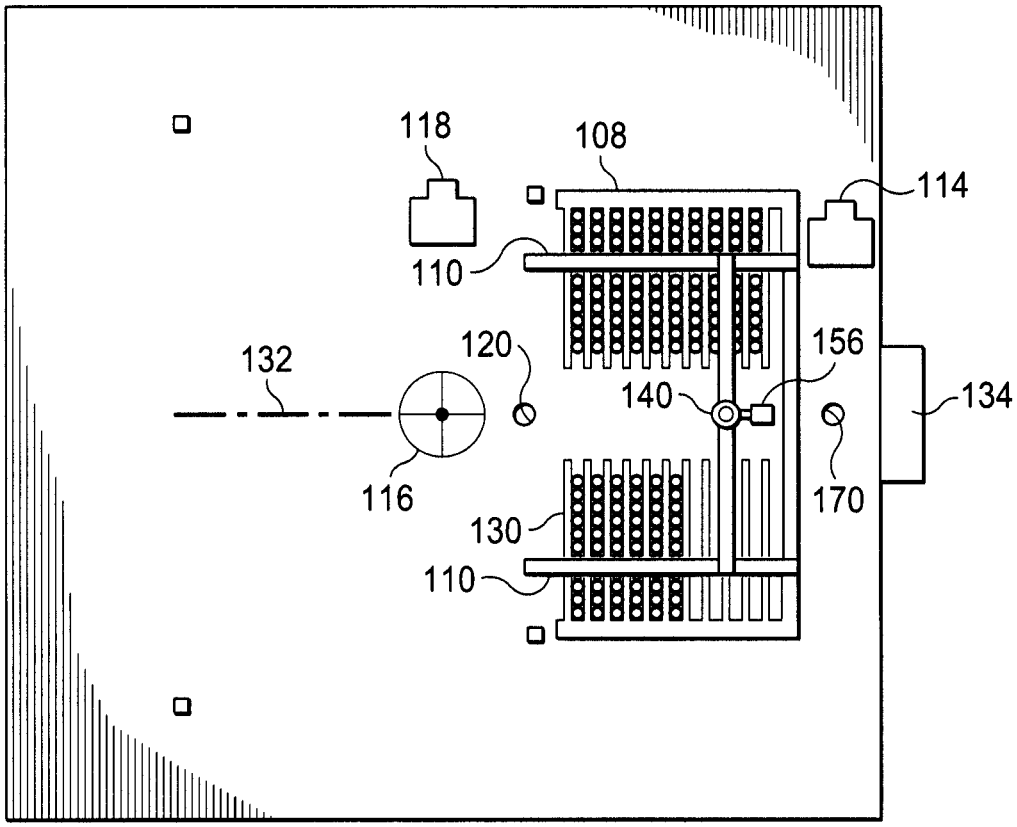
FIG. 9 is a schematic of an exemplary apparatus according to one or more aspects of the present disclosure.

FIG. 9 shows a top profile of another drilling rig modified to have an inline V-door mousehole 170. In this embodiment, the racker device 104 is disposed to draw or build drill pipe stands using the v-door mousehole 170.

Figure 10:
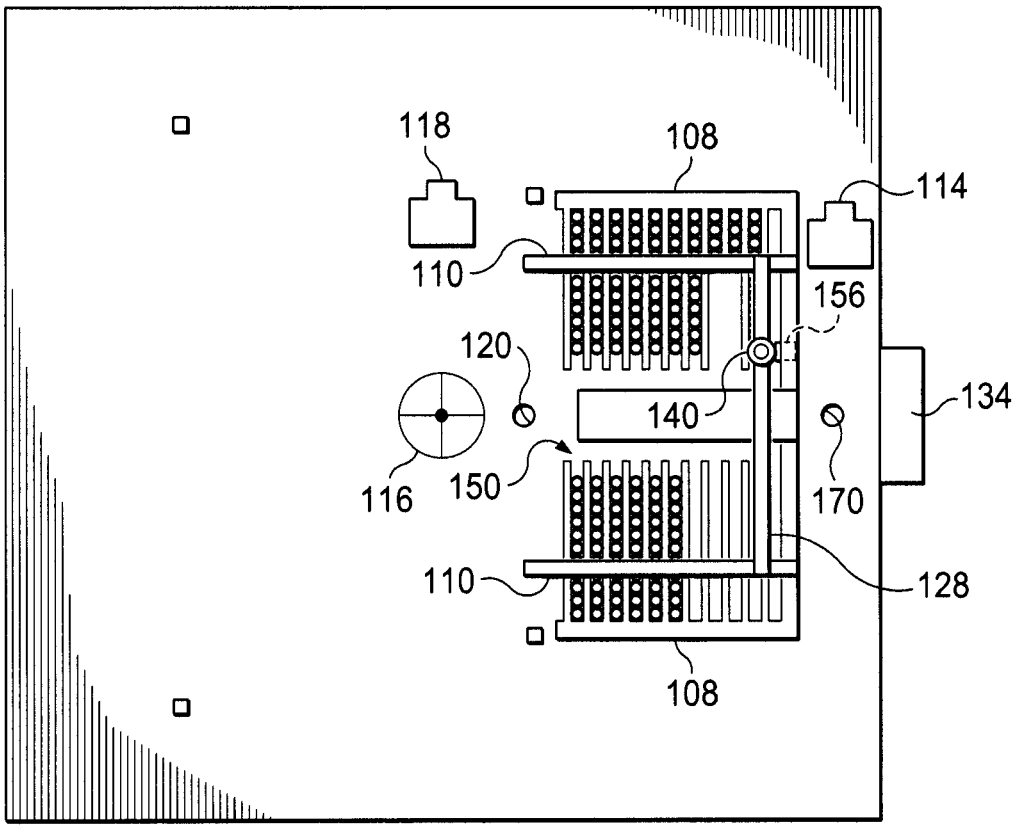
FIG. 10 is a schematic of an exemplary apparatus according to one or more aspects of the present disclosure.

FIG. 10 shows the drilling rig of FIG. 9 from a top profile of the racker device 104 in a stowed position at the right side. As can be seen, when the racker device 104 is in a stowed position, it is offline and is not disposed between the v-door and the well center 116. In addition, because the racker device 104 and the rig based structures and support 102 are formed to have an elevation that does not interfere with conventional operation, the diving board 112 has been placed back down for conventional operation. This may be particularly useful when equipment such as the racker device 104 is down for repair or maintenance. Accordingly, even while the racker device 104 is being maintained, the drilling operation can continue using a conventional diving board and rig crew personnel (not shown).

One of the advantages of the systems and methods disclosed herein is that the systems and methods may be used to convert a conventional mobile drilling rig, as shown in FIG. 1, to a drilling rig having an automatic pipe racker with offline stand building capability as shown in FIGS. 3-9. This may increase the efficiency of operation of the drilling rig.

FIGS. 11-14 show an additional arrangement from a top view with the structural support 102 carrying the racker support column 148. In this embodiment, the structural support 102 includes or comprises a support beam 172. The racker support column 148 hangs from or connects to the support beam 172. Accordingly, the support beam 172 forms at least a part of either one or both the x- and y-direction support structures that makeup at least a part of the structural support 102. In this embodiment, the upper drive carriage 146 may be configured to move along the support beam 172 in the x-direction and the support beam 172 may move along the y-support structure 128 in the y-direction.

Figure 12:
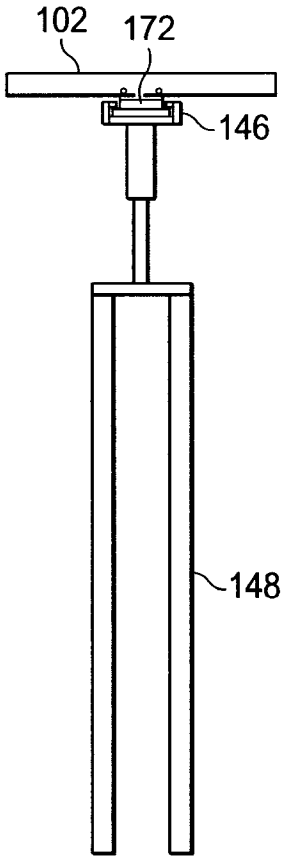
FIG. 12 is a schematic of an exemplary apparatus according to one or more aspects of the present disclosure.
Figure 11:
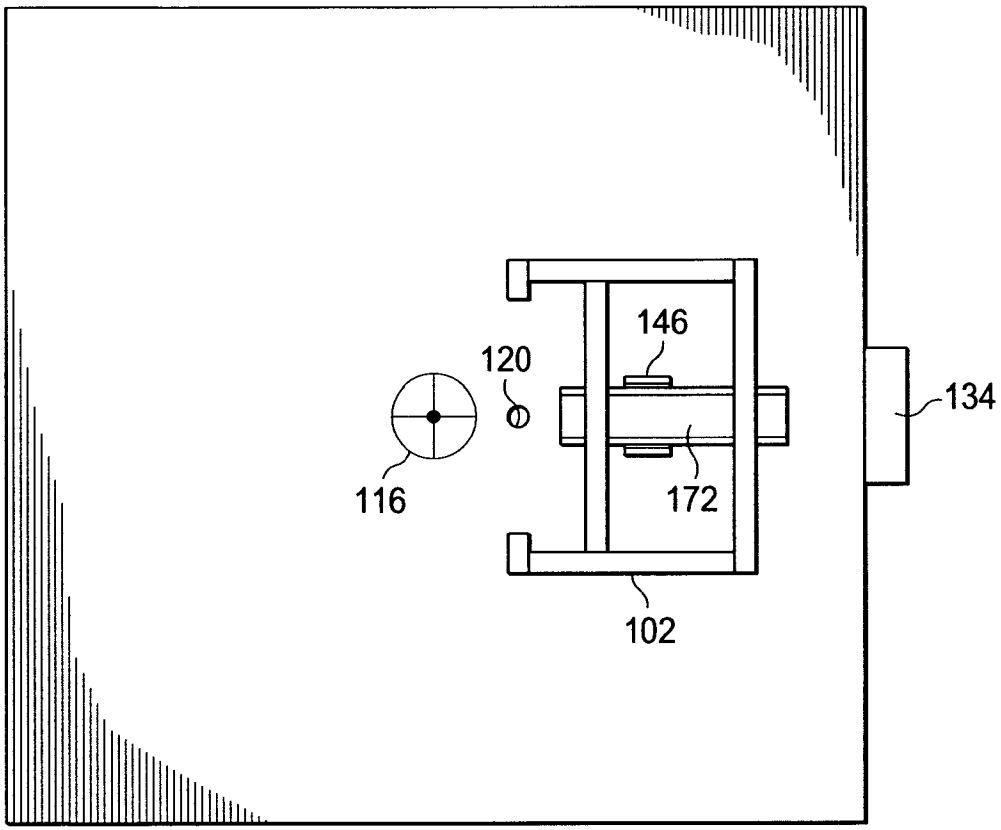
FIG. 11 is a schematic of an exemplary apparatus according to one or more aspects of the present disclosure.

FIG. 11 shows a top view looking down onto the x- and y-direction support structures 110, 128, and FIG. 12 shows a side view of a portion of the support beam 172 with the upper drive carriage 146 attached thereto, and with the support beam moveably attached to the y-support structure 128. Only the top portion of the racker support column 148 is shown in FIG. 12.

Figure 14:
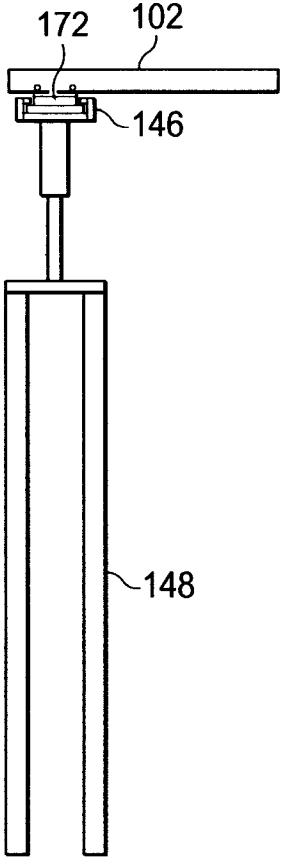
FIG. 14 is a schematic of an exemplary apparatus according to one or more aspects of the present disclosure.
Figure 13:
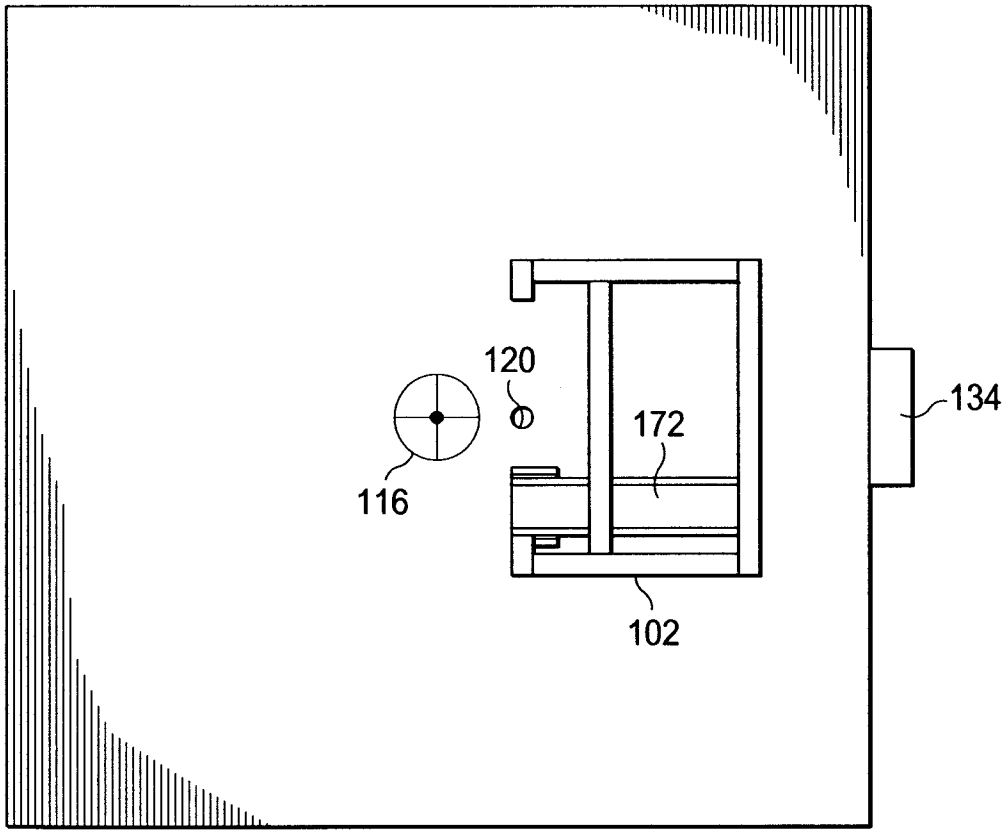
FIG. 13 is a schematic of an exemplary apparatus according to one or more aspects of the present disclosure.

FIGS. 13 and 14 show the support beam and the racker support column 148 in a parked position. As can be seen, the upper drive carriage 146 has moved in the x-direction toward the end of the support beam. In this embodiment, the support beam 172 has also moved in the x-direction from the position shown in FIG. 11. As such, the racker support column 148 is parked on the left side in a position closest to well center. FIG. 14 shows a side view of a portion of the support beam 172 with the upper drive carriage 146 and the racker assembly disposed on a left side, parked offline.

Figure 15:
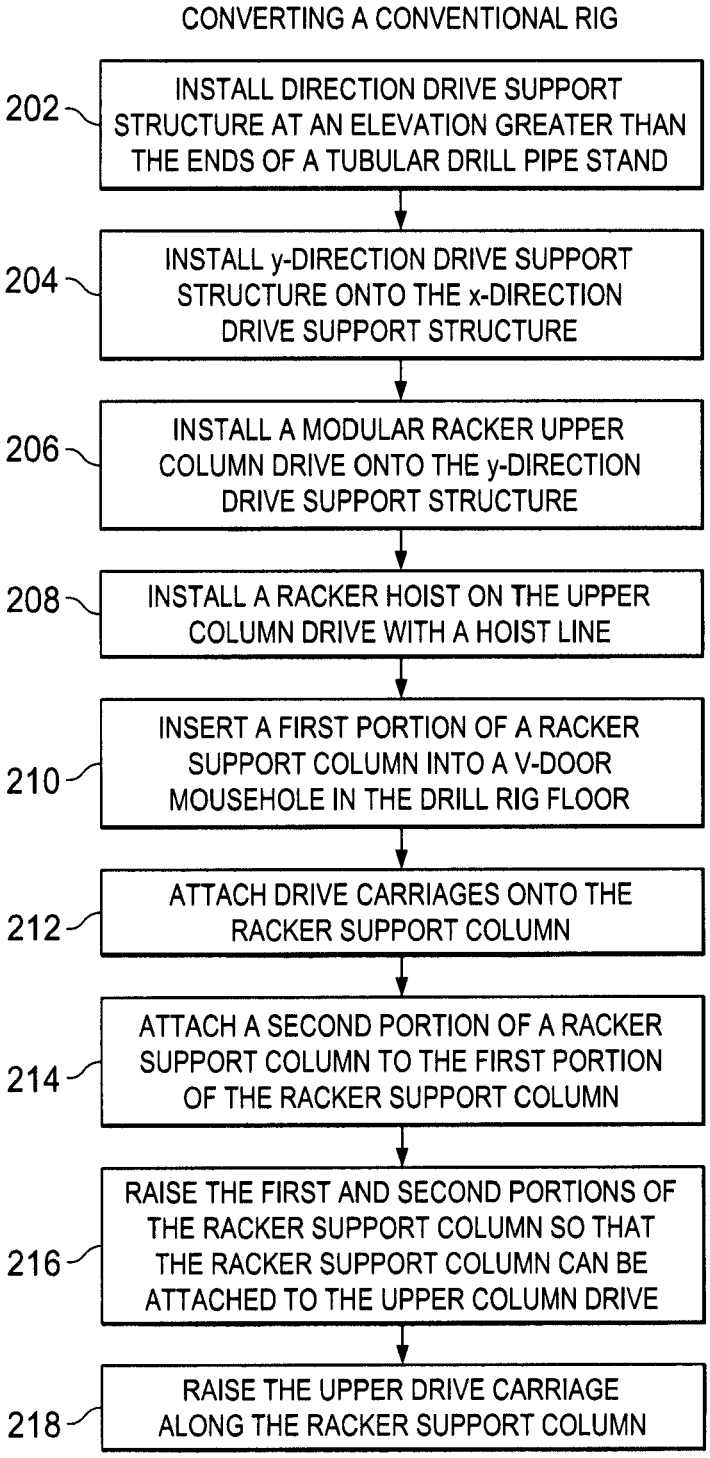
FIG. 15 is a flow chart showing a method according to one or more aspects of the present disclosure.

FIG. 15 is a flow chart showing steps of a method for converting a conventional drilling rig to one with offline pipe stand capability. The method begins at a step 202, and includes a step of installing an x-direction drive support structure 110 on the mast of the conventional drilling rig. This may include attaching the support columns via a welding process, a bolting process, or a combination of both processes to secure the x-direction drive support structures 110 in place. In some embodiments, this includes installing dual support structures parallel to and offset from a line between the well center 116 and the v-door on the drilling rig. In some embodiments, the x-direction drive support structure 110 is installed at an elevation higher than the top of stands that may be maintained within a fingerboard. In some embodiments, this may also include pivoting a diving board from a horizontal position to a vertical position to provide sufficient space for the racker device 104. In other embodiments, it includes removing the diving board entirely.

At a step 204, the y-direction support structure 128 is installed onto the x-direction drive support structure 110. In the embodiments shown the y-direction support structure 128 is configured to move along the x-direction support structure 110. Accordingly, the x-direction drive support structure 110 may act as rails along which the y-direction support structure 128 may roll. The y-direction support structure 128 may be configured to move along the x-direction support structures 110 in a direction toward and away from the well center 116 along a line between the well center and the V-door 134. In some embodiments, the y-direction drive support structure 128 is installed at an elevation higher than the top of stands that may be maintained within a fingerboard. In some embodiments, the y-direction drive support structure 128 is disposed at an elevation higher than stands in the fingerboard, while the x-direction drive support structure 110 is disposed at an elevation lower than stands in the fingerboard. Offsets may extend between the x-direction drive support structure 110 and the y-direction drive support structure so that one of the x and y-direction support structures 110, 128 is disposed above and can move above the stands without interference.

An upper column drive 140 may be installed on the y-direction support structure 128 at a step 206. In one embodiment, the upper column drive 140 is a motorized element configured to drive along the y-direction support structure in the y-direction. The upper column drive 140 may be used to move the racker support column 148 in the y-direction when fully connected.

At a step 208, a racker hoist 142 may be installed on the upper column drive 140. The racker hoist 142 may include a hoist line (not shown) and may be configured and arranged to move a drive carriage, such as the upper drive carriage 146 up and down along the racker support column 148, after the racker support column 148 is built as discussed below. It may also be configured to move drill pipe stands up and down. Since the racker hoist 142 is carried by the upper column drive 140, the racker hoist 142 may be moved by the upper column drive 140 along the y-direction drive support structure 128 in the y-direction.

At a step 210, a first portion of a racker support column 148 is inserted into a V-door mousehole in the drill rig floor. This first portion of the racker support column 148 may be a lower half or a lower third, for example, of the racker support column 148. The first portion of the rack support column may be raised to a vertical position using the hoist 142 and the hoist line, and then lowered into the mousehole so that only a portion of the first portion is disposed above the rig floor.

At a step 212, drive carriages are attached onto the first portion of the racker support column. In some embodiments, this includes attaching the lower drive carriage 144 and the upper drive carriage 146. The upper drive carriage 146 may be configured to vertically slide along the racker support column 148 and the lower drive carriage 144 may be configured to carry the racker support column 148 when assembled. In some embodiments, the lower drive carriage 144 is also configured to move along lower rails extending in the x-direction. A pivot element may be installed and used to rotate the lower drive carriage 144 from travel in the x-direction to travel in the y-direction. The hoist 142 may be used to lower the hoist line to the upper drive carriage 144.

At a step 214, a second portion of a racker support column 148 is attached to the first portion of the racker support column 148. This may include introducing the second portion through the v-door, and attaching the second portion of the racker support column 148 to the first portion, which may be disposed in the mousehole. This step may be repeated as many times as necessary to build the racker support column to a desired height. In some embodiments, the racker support column includes only two portions that are assembled together. In some other embodiments, the racker support column includes three portions that are assembled together. Other embodiments include only a single support column or four or more portions of the support column.

At a step 216, the connected portions of the racker support column 148 may then be raised so that the racker support column 148 can be attached to the upper column drive 140. At a step 218, the upper drive carriage may be raised along the racker support column 148.

In some examples of the method in FIG. 15, the conventional rig is converted to a rig by installing assemblies or modules of components that simplify the convention process. In some examples, the racker support column 148 is introduced to the rig in a single piece. For example, in some methods, the racker support column 148 is assembled on the ground, and then hoisted in one piece using a hoist, such as, for example, the rig drawworks, a winch on the rig floor, a crane and/or the top drive. In some examples, the lower drive carriage 144 and the floor track 160 are disposed on the rig floor in the manner shown in FIGS. 3 and 5-1 to 5-3. This may include installing both the x-direction track and the y-direction track. It may also include installing the turntable to connect the x and y-direction tracks. In some embodiments, the conversion may include installing an upper support assembly onto the mast of the drilling rig. The upper support assembly may include at least one of the x and y-direction support structures 110, 128. These may be disposed above the fingerboard in the manner shown in FIGS. 3 and 4. This may also include installing the upper drive carriage 146 on the x and y-direction support structures 110, 128. Some embodiments include removing or reorienting the conventional diving board to provide operating space for the racker device.

In this example, the racker support column 148 may be assembled on the ground in a relative horizontal orientation. The column hoist, the upper and the lower manipulator arms and gripper heads 156, 154 and the upper drive carriage 146 may also be disposed on the racker support column 148. The hoist line may be attached to the upper end of the racker support column 148 and using a hoist, such as a winch, the rig drawworks and/or the top drive, the upper end of the racker support column 148 may be raised. The assembled racker support column 148 may be lifted from its upper end to a vertical orientation and may be oriented and connected to the lower drive carriage 144, which may be disposed on the tracks. The upper drive carriage 146 at the top of the racker support column 148 may be connected to the x or y-direction support structures 110, 128.

Figure 16:
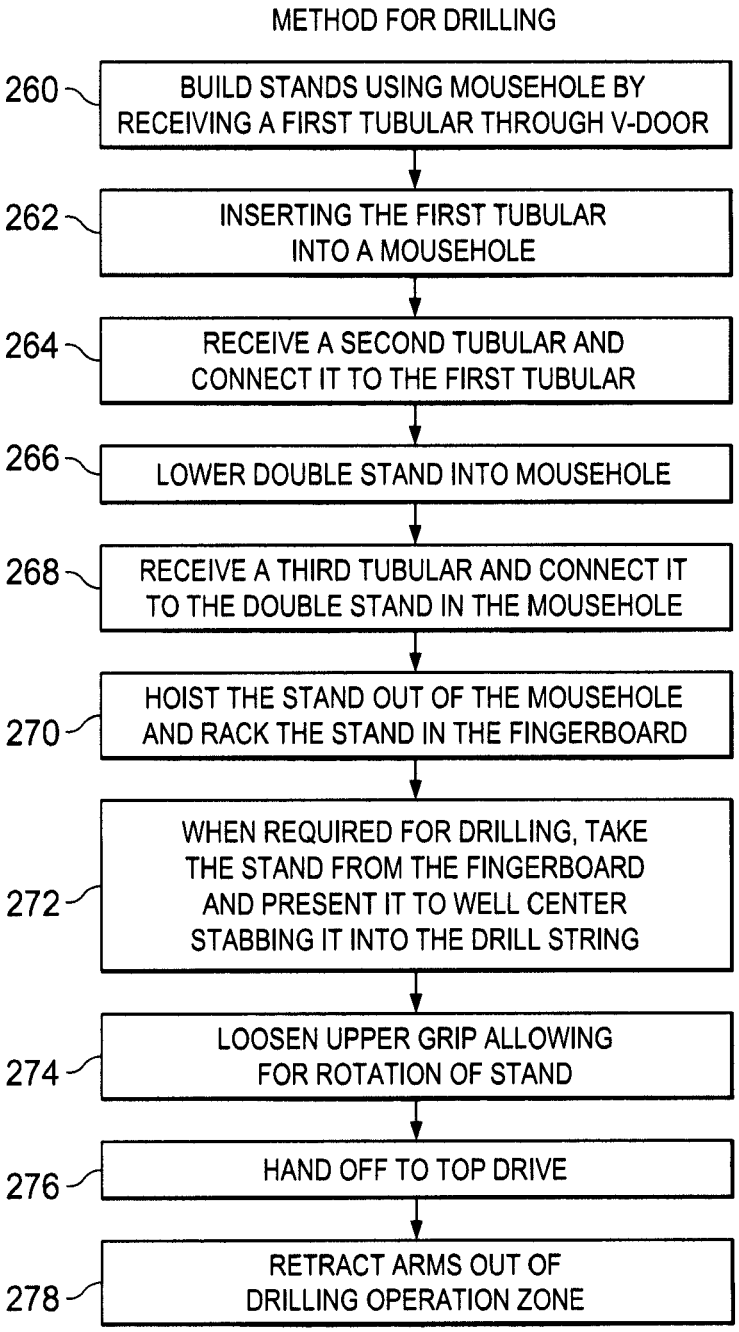
FIG. 16 is a flow chart showing a method according to one or more aspects of the present disclosure.

FIG. 16 is a flow chart showing steps of a method for drilling a well using the system and methods of the present disclosure. The method may be performed using a controller to control the system 100 and to control the movements of the drive carriages 144, 146, the upper column drive 140, the modular racker hoist 142, the lower drive carriage 144, the upper drive carriage 146.

Figure 17:
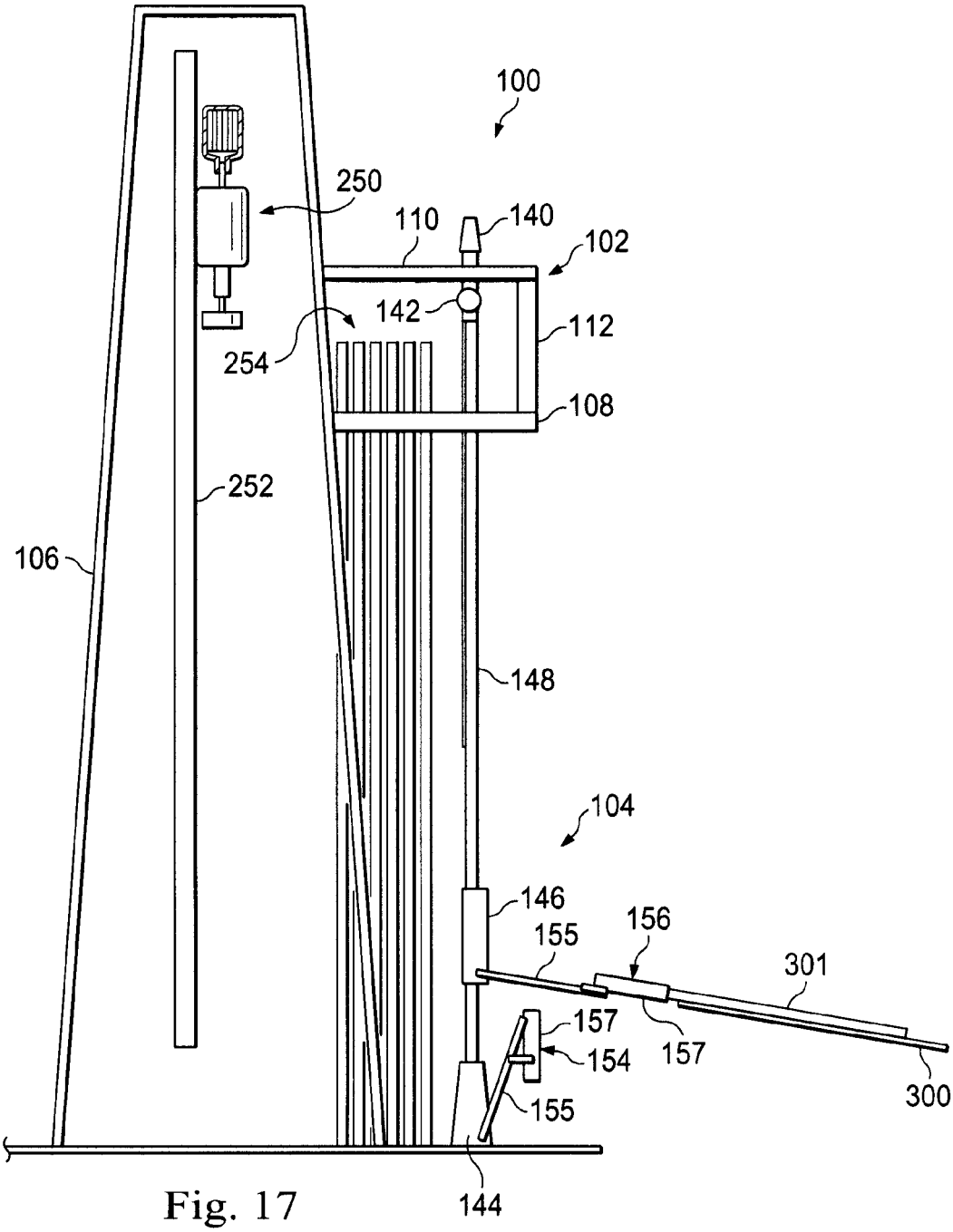
FIG. 17 is a schematic of an exemplary apparatus forming a part of the apparatus of FIG. 3 according to one or more aspects of the present disclosure.

The method in FIG. 16 begins with a process for building a stand using a mousehole with the system 100 described herein by receiving a tubular through the v-door at step 260. In some aspects the stand is built offline. This may increase efficiency of operation of the drilling rig because the stand building does not inhibit or prevent access to the well center. FIG. 17 shows the system 100 including a top drive 250 along a support column 252 in the mast 106. A plurality of stands 254 already is disposed in the fingerboard 108. In this example, the offline stand building may be accomplished using the system 100 described above and using a mousehole, which in some embodiments is an offline mousehole. In one aspect, the mousehole is one of the offline mouseholes 122, 124 disposed offline as shown in FIG. 4 and discussed above. In other aspects, the mousehole is not offline or is elsewhere disposed. FIG. 17 shows the upper manipulator arm and gripper head 156 of the upper drive carriage 146 grasping a first end of a tubular 301 from a feeder slide 300. From the position in FIG. 17, the upper drive carriage 146 may raise the tubular 301 by sliding it vertically along the racker support column 148 with the hoist 142. The tubular 301 may be held by the upper manipulator arm and gripper head 156, while the lower end of the tubular is captured and tailed by the lower manipulator arm and gripper head 154 of the lower drive carriage 144 while the tubular is hoisted into position.

The upper manipulator arm and gripper head 156 and the lower manipulator arm and gripper head 154 may guide the tubular to a mousehole in the rig floor at a step 262. When the tubular is properly aligned with the mousehole, the tubular may be lowered at least partially through the mousehole by passing through the lower manipulator arm and gripper head 154 of the lower drive carriage 144. As the bottom end of the tubular moves in the mousehole, the lower manipulator arm and gripper head 154 of the lower drive carriage 144 may release the tubular 301, while the upper manipulator arm and gripper head 156 continues to force the tubular 301 to the desired height in the mousehole. During this process, a second tubular 304 may be fed onto the feeder slide 300.

The process may then be repeated when the upper manipulator arm and gripper head 156 releases the first tubular disposed within the mousehole and receives a second tubular for connection to the first tubular at a step 264. Here, the upper manipulator arm and gripper head 156 grasps the second tubular on the feeder slide 300 as it is fed into the v-door. The second tubular may be raised off the feeder slide as was the first tubular and may be held by the upper manipulator arm and gripper head 156. The lower end of the second tubular may be captured by the lower manipulator arm and gripper head 154 of the lower drive carriage 144. The upper and lower manipulator arms and gripper heads 156, 154 may guide the second tubular to the mousehole in the rig floor above the first tubular. The second tubular may then be secured to the first tubular to makeup a joint using the iron roughneck to form a double stand. The double stand is then lowered further into the mousehole at a step 266. In some aspects, the process is repeated using a third tubular 306 to makeup a second joint and form a triple stand. For example, at a step 268, the rig receives a third tubular and connects it to the double stand in the mousehole. This may be done in the manner described above using the iron roughneck, for example.

With the stand complete, the triple may be hoisted from the mousehole to be racked in the fingerboard 108 at a step 270. This may include grasping the triple 308 from a region spaced from its upper end and the upper drive carriage 146 may be hoisted using the hoist 142. That is, the hoist 142 may raise the upper drive carriage 146 along the racker support column 148, and with it, the triple. The triple may be grasped or otherwise secured by both the lower and upper drive carriages 144, 146, vertically lifted from the mousehole, and moved and racked in the fingerboard. This may include moving the racker support column 148 in the x or in the x and y-directions. In addition, the racker support column 148 may rotate about an axis to face desired directions. The upper manipulator arm and gripper head 156 of the upper drive carriage 146 may grasp the top of the triple stand and the lower manipulator arm and gripper head 154 of the lower drive carriage 144 may tail the lower portion of the triple stand.

To rack the built stand from the mousehole, the upper and lower manipulator arm and gripper heads 156, 154 retract from an extended position to a retracted position, and the y-direction support structure 128 moves along the x-direction support structure 110 from the mousehole in the gap into the fingerboard 108. Naturally, as the y-direction support structure moves, it carries the racker device 104 with it. The lower and upper manipulator arm and gripper heads 156, 154 rotate about the axis of the racker support column 148 to align the triple with the desired slot between fingers of the fingerboard. This may include rotating the support column 148 or may include rotating the drive carriages 144, 146. In some examples, the lower and upper manipulator arm and gripper heads 156, 154 rotate 90° about an axis associated with the racker support column 148. As such, the triple 308 also rotates. When the triple is aligned as desired, the lower and upper manipulator arm and gripper heads 156, 154 extend outwardly in the y-direction so that the triple 308 passes between fingers of the fingerboard 108 into the fingerboard. When properly located, the lower and upper manipulator arm and gripper heads 156, 154 release the triple 308 in the fingerboard 108, and retract toward the racker support column 148. The lower and upper manipulator arm and gripper heads 156, 154 may then rotate about the axis of the racker support column 148 to a neutral position, where racker support column 148 can be returned to the mousehole to build the next stand.

At a step 272, when required for drilling, the racker device 104 may take the stand from the fingerboard and present the stand to well center. To do this, the racker device may rotate 90° about an axis of the racker support column 148 to grasp a stand from between fingers of the fingerboard. The racker device 104 may move via the y-direction drive support structure which may move along the x-direction drive support structure toward the well center 116. In some embodiments, the system 100 may be configured to take stands from the fingerboard 108 that are closest to the well center. This may provide efficiency in operation and may speed the drilling process. When the racker device is aligned as desired, the lower and upper manipulator arm and gripper heads 156, 154 extend to grasp a stand in the fingerboard 108.

After the lower and upper manipulator arm and gripper heads 156, 154 grasp a stand from the fingerboard, they may retract with the stand toward the racker support column 148. They may then rotate about the axis of the racker support column 148 to face the well center 116. The racker device 104 may advance toward the well center 116 by being carried on the y-direction drive support structure as it advances on the x-direction drive support structure 110. When the racker device 104 is properly positioned, the lower and upper manipulator arm and gripper heads 156, 154 may extend from the racker support column 148 until the stand is directly over the well center 116. In some embodiments, the lower and upper manipulator arm and gripper heads 156, 154 stab the stand into the drill string. In this position, the stand is also directly aligned with the top drive 250 in FIG. 17. The lower and upper manipulator arm and gripper heads 156, 154 may then lower the stand into the well center. With the stand in place, the upper manipulator arm and gripper head 154 loosens the grip on the stand to allow the stand to rotate at a step 274.

An iron roughneck may make up a joint between the new stand and a previous stand. The stand may then be handed off to the top drive at a step 276. That is, with the stand in place, the top drive 250 may be lowered onto and may engage the end of the stand. The lower and upper manipulator arm and gripper heads 156, 154 release the stand and retract toward the racker support column 148 out of the line of the top drive at a step 278. The top drive may then advance downward along the support driving the stand into the well center. As this occurs, the racker device 104 may simultaneously move along the x-direction support structure away from its ends. The top drive may continue to drive the stand downward into the well center, and afterward, may retract along the support column 252 to its upward location so that it is ready for the next stand.

Figure 18:
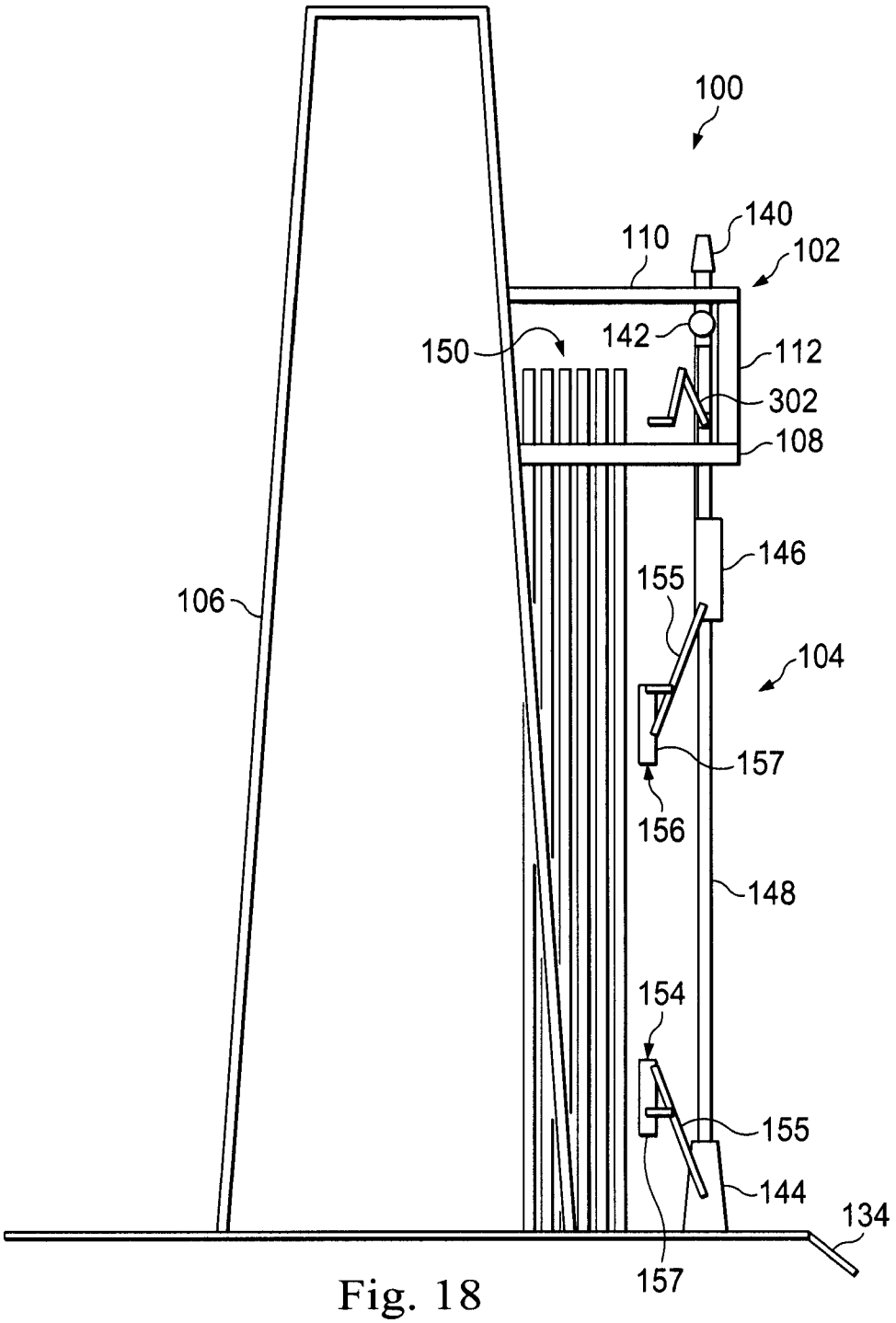
FIG. 18 is a schematic of an exemplary apparatus forming a part of the apparatus of FIG. 3 according to one or more aspects of the present disclosure.

FIG. 18 shows the system 100 of FIG. 3 including a guide arm 302. The guide arm 302 is configured to stabilize the tubular and assist the racker device 104 in placing the tubular in the fingerboard 108. In some embodiments, the upper drive carriage 146 with its upper manipulator arm and gripper head 156 secures the tubular below the fingerboard 108. The distance in height from the gripper head's 157 location on the tubular and the fingerboard 108 can result in the tubular oscillating even while being held by the upper and lower gripper heads 157. This oscillation can be the result of wind, vibrations of the drilling systems and of the racker device 104 itself. In some embodiments, the fingers of the fingerboard 108 are spaced to allow for less than 1 inch in spacing above the size of the tubular, and in some embodiments, only ¼ to ½ inch in spacing above the size of the tubular. However, in some aspects, tubular movement above the gripper can vary from 1 to 3 degrees during normal operation. Therefore, if the upper gripper head 157 secures a triple stand formed of tubulars, such as, for example, at the 70 foot section, the tubular may have, for example, 1-3 degrees of oscillation of the tubular in the 23-26 feet of tubular above the upper gripper head 157. This may equate to an oscillation of up to 5 inches making the emplacement of the tubular into the fingerboard 108 a challenge. The guide arm 302 may assist by reducing oscillation and aligning the stand with the spacing between fingers of the fingerboard 108. In some embodiments, the guide arm 302 is disposed within an elevation of about 8 feet of the fingerboard elevation. The guide arm 302 may be configured to extend using jointed arms and hydraulic control in a manner known in the art. The guide arm may be formed of two parallel extending fingers that receive a stand therebetween, and provide support to align the top end of the stand with the opening between fingerboards. In some embodiments, the fingerboard includes latches and the guide arm 302 is configured to open a latch when inserting a stand into or removing a stand from the fingerboard. The guide arm 302 may also be under the control of a controller, along with other elements of the system 100.

In view of all of the above and the figures, one of ordinary skill in the art will readily recognize that the present disclosure introduces an apparatus comprising: an x-direction support structure extending in the same direction as a line extending between a well center and a V-door on a drilling rig; a y-direction support structure moveable relative to the x-direction support structure, the y-direction support structure extending on a drilling rig in a direction transverse to the line extending between the well center and the V-door on the drilling rig; a racker device retained by one of the x-direction and the y-direction support structures, the racker device being configured to connect to and carry a tubular stand used in a well drilling process, the racker device being moveable along the y-direction support structure from a position inline with the line extending between the well center and the V-door on the drilling rig to a position offline from the line extending between the well center and the V-door on the drilling rig to provide space for additional drilling equipment along the line extending between the well center and the V-door on the drilling rig. The racker device comprises: an upper carriage having an upper extending arm configured to selectively connect with the tubular stand; a lower carriage disposed at a location lower than the upper carriage, the lower carriage having a lower extending arm configured to selectively connect with the tubular stand; and a lift system, such as a hoist, configured to raise and lower the upper carriage.

In an aspect, the racker device comprises a racker support column, the upper and lower carriages being connected with the racker support column. In an aspect, the racker support column is configured to angularly rotate around an axis of the racker support column while being connected with the upper and lower carriages. In an aspect, the x-direction support structure is offset or disposed offline from the line extending between the well center and the V-door on the drilling rig. In an aspect, the apparatus comprises a fingerboard, at least one of the x-direction and the y-direction support structures being disposed at an elevation higher than the fingerboard. In an aspect, the apparatus includes a guide arm configure to guide tubulars into and out of the fingerboard fingers, the guide arm being disposed on the racker support column at about the same height as the fingerboard. In an aspect, the guide arm is configured to releasably close a latch on the fingerboard to secure one or more stands of pipe within the fingerboard. In an aspect, the x-direction support structure is disposed directly above the fingerboard. In an aspect, wherein the x-direction support structure comprises two parallel rails disposed on opposing sides of the line extending between the well center and the V-door on the drilling rig. In an aspect, the apparatus comprises a floor track having a first portion extending in the x-direction and a second portion extending in the y-direction, the racker device being moveable along the floor track. In an aspect, the floor track comprises a turntable connecting the first and second portions of the floor track. In an aspect, the apparatus comprises a mousehole disposed offline from the well center, the upper extending arm extending in a manner so that the upper carriage can capture an upper end of a tubular and hold the tubular to place it down inside the mousehole. In an aspect, the upper extending arm is configured to manipulate a tubular stand from a horizontal position to a vertical position, and the lower extending arm is configured to tail a lower section of the tubular as it transitions from the horizontal position to the vertical position.

The present disclosure also introduces a method of installing a modular pipe racker on a mobile drilling rig, comprising: installing an x-direction drive support structure extending in the same direction as a line extending between a well center and a V-door on the drilling rig; installing a y-direction drive support structure to cooperate with the x-direction drive support structure so that the y-direction drive support structure can move in the direction of the line extending between the well center and the V-door on the drilling rig; and installing a modular racker device onto said one of the x-direction and the y-direction support structures, comprising: installing an upper column drive onto one of the x-direction and the y-direction drive support structures, the upper column drive being configured to move the modular racker device in the y-direction from a position along the line extending between the well center and the V-door on the drilling rig toward a position offline from the line extending between the well center and the V-door on the drilling rig.

In an aspect, installing a modular racker device comprises connecting upper and lower drive carriages to a racker support column moved by the upper column drive so that the upper and lower drive carriages move between the position offline and the position inline with the upper column drive. In an aspect, the method comprises displacing a previously installed diving board. In an aspect, displacing a previously installed diving board comprises pivoting the diving board from a horizontal to a vertical position.

The present disclosure also introduces a method of building a stand offline on a mobile drilling rig, comprising: laterally displacing a racker device from a position inline with a line between well center and a V-door on the drilling rig to a position offline from the line between well center and the V-door; with the racker device in the offline position, grasping a first tubular with an upper drive carriage of the racker device; grasping the first tubular with a lower drive carriage of the racker device; inserting the first tubular into a mousehole in the drilling rig floor; with the racker device in the offline position, grasping a second tubular with the upper drive carriage of the racker device; grasping the second tubular with the lower drive carriage of the racker device; inserting the second tubular into the mousehole in the drilling rig floor to build the stand; returning the racker device from the position offline from the line between well center and the V-door.

In an aspect, the method comprises using an offline iron roughneck to attach the first and second tubulars. In an aspect, the method comprises attaching a third tubular to the first and second tubulars to build a triple stand.

The present disclosure also introduces a method of racking tubulars from a mousehole on a drilling rig, comprising: pulling a stand of tubulars from a mousehole with a racker device having extending arms and orienting the stand in a substantially vertical position; moving the racker device with the stand along a line between well center and a V-door on the drilling rig by displacing the racker device with a y-direction drive support structure that is associated with an x-direction drive support structure, the x-direction drive support structure extending in a direction parallel to and offset from the line between well center and the V-door on the drilling rig, the x-direction support structure having a height greater than a height of the stand so that the y-direction drive support structure moves over stands in a fingerboard; and rotating the racker device with the stand and extending the extending arms of the racker device to insert the stand into the fingerboard.

In an aspect, the mousehole is disposed offline from the line between well center and the V-door on the drilling rig, the method comprising laterally displacing the racker device to a position offline to access the stand in the mousehole. In an aspect, the method comprises stowing the racker device by laterally displacing the racker device to a position offline from the line between well center and the V-door on the drilling rig.

The present disclosure also introduces a method of racking to a top drive, comprising: pulling a stand from a fingerboard with a racker device so that the stand is in a substantially vertical position; moving the racker device with the stand along a line between well center and a V-door on the drilling rig by displacing the racker device with a y-direction drive support structure that is carried on an x-direction drive support structure, the x-direction drive support structure extending in a direction parallel to and offset from the line between well center and the V-door on the drilling rig, the x-direction support structure having a height greater than a height of the stand so that the y-direction drive support structure moves over stands in a fingerboard; and placing the stand with the racker device in a location over well center below a top drive; and engaging the stand with the top drive.

In an aspect, the x-direction support structure comprises two parallel supports disposed above the fingerboard. In an aspect, the method comprises stowing the racker device by laterally displacing the racker device to a position offline from the line between well center and a V-door on the drilling rig.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. A method of installing a modular pipe racker device on a mobile drilling rig, comprising:

installing an x-direction drive support structure extending in the same direction as a line extending between a well center and a V-door on the mobile drilling rig;

installing a y-direction drive support structure to cooperate with the x-direction drive support structure so that the y-direction drive support structure is moveable in the x-direction on the drilling rig; and installing a modular column racker device onto one of the y-direction and x-direction support structures, the modular column racker device having an upper column drive, a lower drive carriage, and a racker support column extending between the upper column drive and the lower drive carriage and being arranged to move drillpipe, installing the modular column racker device comprising:

installing a structure including the upper column drive that permits the upper column drive to move an upper end of the racker support column in the y-direction from a position along the line extending between the well center and the V-door on the drilling rig toward a position offline from the line extending between the well center and the V-door on the drilling rig; and supporting a lower end of the racker support column with the lower drive carriage by positioning the racker support column to extend substantially vertically from the moveable lower drive carriage to bear weight of a load carried by the modular column racker in a manner that permits the lower end of the modular column racker to move in the y-direction from a position along the line extending between the well center and the V-door on the drilling rig toward a position offline from the line extending between the well center and the V-door on the drilling rig.

2. The method of claim 1, wherein installing a modular racker device comprises connecting an upper drive carriage to the racker support column moveable by the upper column drive so that the upper and lower drive carriages move between the position offline and a position inline with the line extending between a well center and a V-door.

3. The method of claim 1, comprising displacing a previously installed diving board.

4. The method of claim 3, wherein displacing a previously installed diving board comprises pivoting the diving board from a horizontal to a vertical position.

5. The method of claim 1, comprising installing a racker hoist on the upper column drive, the racker hoist being attachable to and arranged to hoist a portion of column racker device.

6. The method of claim 1, comprising inserting at least a portion of a racker support column through a v-door on the drilling rig and, lowering the portion of the racker support column into a mousehole in a drilling rig floor.

7. The method of claim 6, comprising:

inserting a second portion of a racker support column through the v-door and attaching it to said at least a first portion of the racker support column; and raising the first and second portions of the racker support column and attaching the support column to the upper column drive.

8. The method of claim 7, comprising resting the lower end of the first and second portions of the racker support column on the moveable lower drive carriage.

9. A method of building a stand offline on a mobile drilling rig, comprising:

laterally displacing a column racker device from a position inline with a line between well center and a V-door on the drilling rig to a position offline from the line between well center and the V-door by displacing an upper end of the column racker device from the position inline with the line and by displacing moveable support constructs supporting a lower end of the column racker device from the position inline with the line;

with the column racker device in the offline position, grasping a first tubular with an upper drive carriage of the column racker device;

grasping the first tubular with a lower drive carriage of the column racker device so that the column racker device supports weight of the first tubular at the lower end;

inserting the first tubular into a mousehole in a drilling rig floor;

with the column racker device in the offline position, grasping a second tubular with the upper drive carriage of the racker device so that the column racker device supports weight of the first tubular at the lower end;

grasping the second tubular with the lower drive carriage of the column racker device;

inserting the second tubular into the mousehole in the drilling rig floor to build the stand; and returning the column racker device from the position offline onto the line between well center and the V-door.

10. The method of claim 9, comprising using an offline iron roughneck to attach the first and second tubulars.

11. The method of claim 9, compromising attaching a third tubular to the first and second tubulars to build the stand.

12. The method of claim 9, comprising:

raising the attached first and second tubulars using the upper drive carriage;

grasping the raised first and second tubulars using the lower drive carriage, and displacing the lower drive carriage along the rig floor to a position suitable for racking the attached first and second tubulars or for introducing to well center.

13. A method of racking tubulars from a mousehole on a drilling rig, comprising:

pulling a stand of tubulars from a mousehole with a vertically disposed column racker device having an upper column drive, a lower drive carriage, and a racker support column extending between the upper column drive and the lower drive carriage, the column racker device also having extendable arms and orienting the stand in a substantially vertical position;

moving the column racker device with the stand along a line between well center and a V-door on the drilling rig by displacing the column racker device with a y-direction drive support structure that is associated with an x-direction drive support structure, the x-direction drive support structure extending in a direction parallel to and offset from the line between well center and the V-door on the drilling rig, the x-direction support structure having a height greater than a height of the stand so that the y-direction drive support structure moves over the stand in a fingerboard;

supporting weight of the of the support column and the stand on the lower drive carriage disposed directly below a lower end of the support column while the lower end moves along the line between well center and the V-door; and rotating the support column with the stand and extending the extendable arms of the column racker device to insert the stand into the fingerboard.

14. The method of claim 13, wherein the mousehole is disposed offline from the line between well center and the V-door on the drilling rig, the method comprising laterally displacing the racker device to a position offline to access the stand in the mousehole.

15. The method of claim 13, further comprising stowing the racker device by laterally displacing the racker device to a position offline from the line between well center and the V-door on the drilling rig.

16. The method of claim 13, wherein moving the column racker device with the stand along a line between well center and a V-door on the drilling rig also includes displacing the lower drive carriage along a rig floor.

17. The method of claim 16, wherein moving the column racker device by displacing the lower drive carriage along a rig floor includes driving the lower drive carriage at the lower end of the column racker along a track.

18. The method of claim 17, wherein the track is one or more rails.

19. The method of claim 13, wherein moving the column racker device with the stand along a line between well center and a V-door on the drilling rig by displacing the racker device with a y-direction drive support structure that is associated with an x-direction drive support structure comprises moving the upper column drive along one of the x-direction and y-direction drive support structures.

20. The method of claim 19, further comprising rotating the column racker via a rotation driver carried by one of the upper and lower column drives.

* * * * *